United States Patent [19]

Aasen et al.

[11] 4,084,901

[45] Apr. 18, 1978

[54] COPYING MACHINE

[75] Inventors: Torulf F. Aasen, Hollywood, Fla.; Jules Nisenson, Southbury; Charles E. Pegg, Danbury, both of Conn.

[73] Assignee: Pitney-Bowes, Inc., Stamford, Conn.

[21] Appl. No.: 670,253

[22] Filed: Mar. 25, 1976

[51] Int. Cl.[2] ..... G03G 15/00

[52] U.S. Cl. ..... 355/16; 355/3 R; 355/14

[58] Field of Search ..... 355/16, 3 R, 3 BE, 72, 355/3 FO, 14

[56] References Cited

U.S. PATENT DOCUMENTS

| | | | |
|---|---|---|---|
| 3,575,505 | 4/1971 | Parmigiani | 355/3 BE |
| 3,604,797 | 9/1971 | Szczesniak | 355/16 |
| 3,606,532 | 9/1971 | Shelffo et al. | 355/16 |
| 3,661,452 | 5/1972 | Hewes et al. | 355/3 BE |
| 3,697,163 | 10/1972 | Jordan | 355/16 |
| 3,984,241 | 10/1976 | Schrempp et al. | 355/16 |
| 3,989,236 | 11/1976 | Komori et al. | 355/24 |

*Primary Examiner*—William M. Shoop
*Attorney, Agent, or Firm*—Thomas R. FitzGerald; William D. Soltow, Jr.; Albert W. Scribner

[57] ABSTRACT

A copying machine in which a photo-receptor sheet, wound between supply and take-up reels, serves as an intermediate web which is charged, exposed and developed with toner; the toner then being transferred to copy paper. The photo-receptor sheet is advanced incrementally from the supply reel to the take-up reel during each copy cycle. After substantially all of the sheet is wound on the take-up reel, it is rewound on the supply reel, following which it is moved once again in incremental steps in the forward direction during copy cycles. The supply and take-up reels are mounted in a highly compact module which is easily plugged into or removed from the base section, without requiring any threading of the photo-receptor sheet over elements within the base section. In this way, practically all that is required during a service call to replace the photo-receptor sheet is to substitute one module with a new photo-receptor sheet for the previously used module with the old photo-receptor sheet. The module is made highly compact by providing for a relatively long sheet path within the module past the various copying-step positions, the path length being considerably longer than the length of the minimum tangential line between the wound reels. Elements in the base section for controlling the copying step functions are arranged around the path in facing relationship with respective copying step positions in the module.

31 Claims, 26 Drawing Figures

| | |
|---|---|
| 3A | 3B |
| 3C | 3D |
FIG. 3e
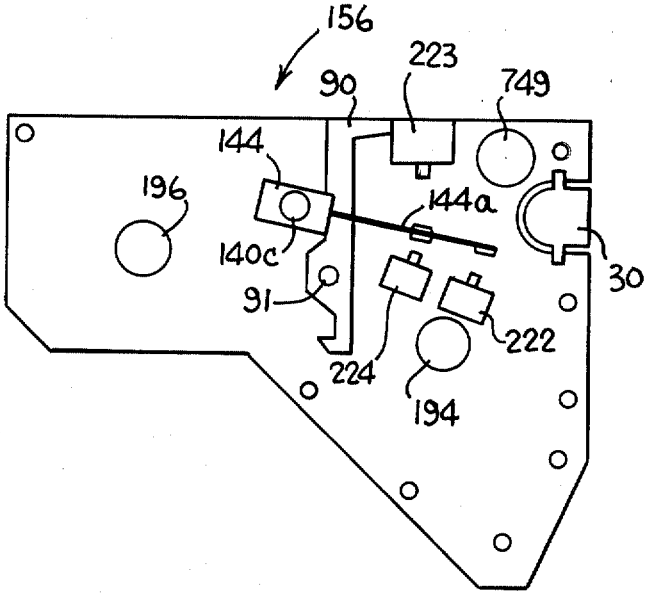
FIG. 5
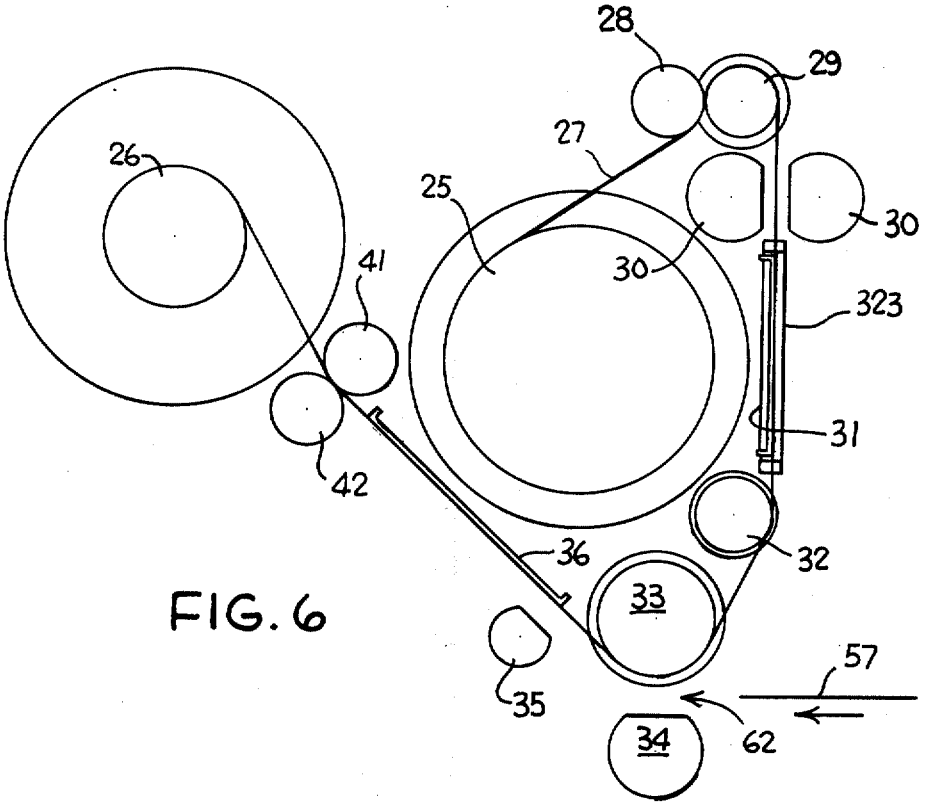
FIG. 6

FIG. 7
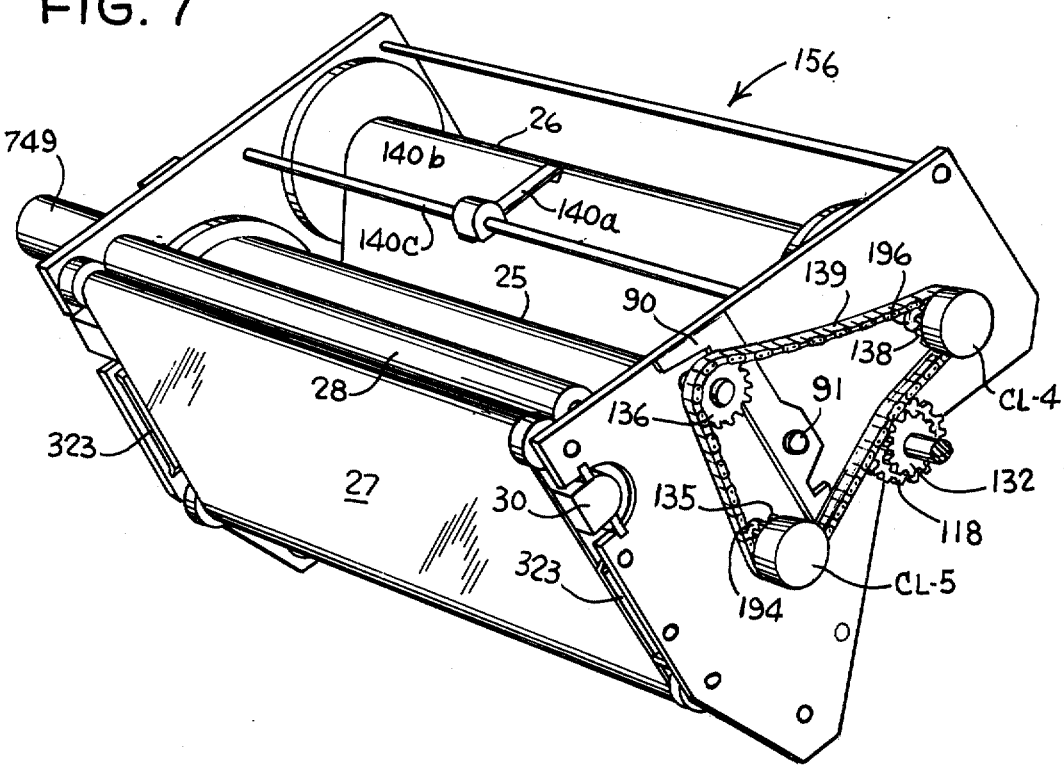
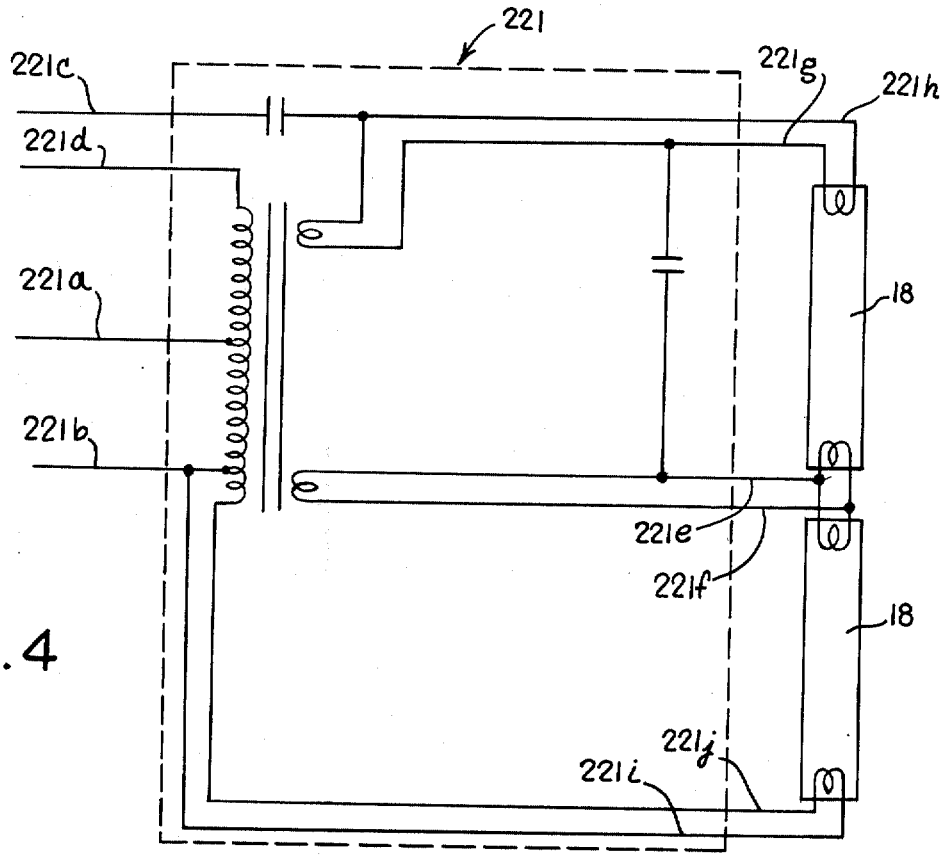
FIG. 4

FIG. 9
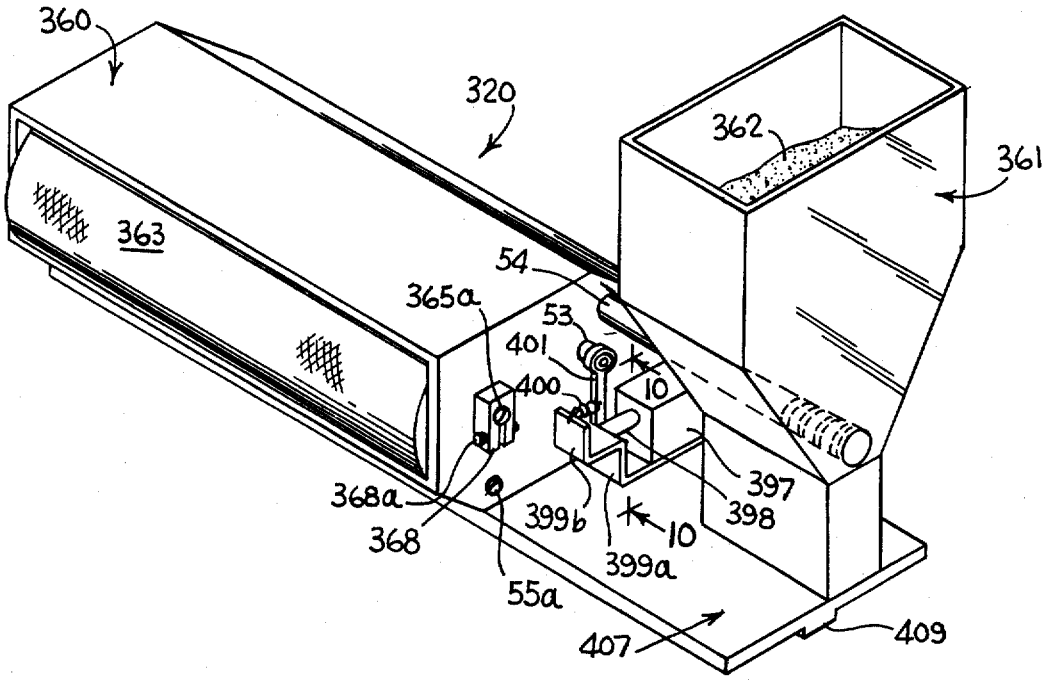
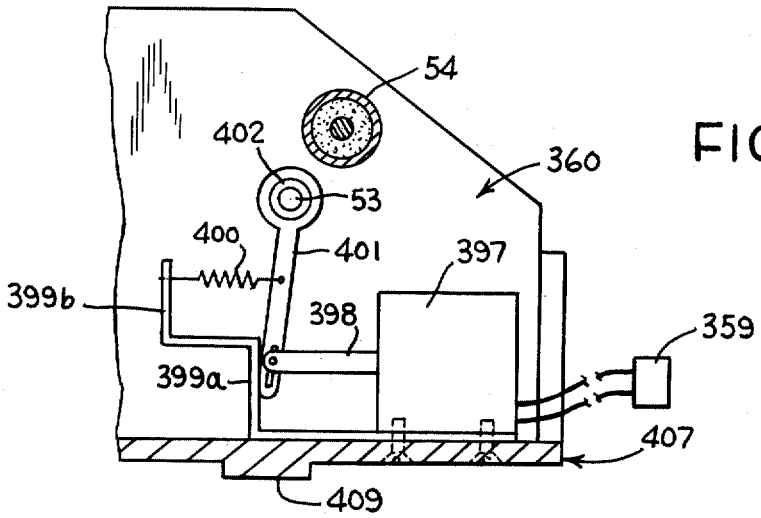
FIG. 10

COPYING MACHINE

BACKGROUND OF THE INVENTION

1. Field of the Invention

This invention relates to copying machines of the type which utilize a photo-receptor sheet as a toner-transfer medium and which is advanced between supply and take-up reels during the copying cycles, and more particularly to such a machine in which the photo-receptor sheet is wholly contained within a highly compact module.

2. Description of the Prior Art

In many of the earliest xerographic machines, a photo-receptor drum, for example, a drum coated with selenium, was first charged and then exposed in accordance with the scanning of an original document to be copied. The drum was then developed by applying toner to the remaining charged areas on the drum, and finally the toner was transferred from the drum to plain copy paper. In other early machines, primarily those marketed by companies other than Xerox Corporation, the copy paper itself was coated with a photo-receptor such as zinc oxide. These machines did not utilize a separate drum, and it was the zinc oxide coating which was charged, exposed and then developed with toner.

The use of an intermediate drum allows the finished copies to be made on plain bond paper. But the per-copy cost is relatively expensive due primarily to the high cost of the drum. On the other hand, although the per-copy cost is much lower when zinc-oxide coated paper is utilized, the fact that the final copy sheet has a zinc-oxide coating is a serious disadvantage and objectionable to many users.

For these reasons, in order to reduce the per-copy cost and yet allow copies to be made on plain bond paper, several proposals have been made for what might be considered to be a sort of hybrid machine. Instead of using a selenium drum, a photo-receptor sheet is used for charging, exposing and developing, with the toner on the sheet then being transferred to plain bond copy paper. Typically, a zinc-oxide photo-receptor sheet is used as an intermediate web serving in the same capacity as a selenium drum. Due to the low cost of the zinc-oxide coated sheet which is used as the intermediate web, the per-copy cost is greatly reduced.

Unfortunately, a zinc-oxide coated sheet exhibits optical fatigue. At best, it can be charged and exposed only several hundred times before it is no longer useable. For this reason, any practical machine which utilizes an intermediate photo-receptor sheet is provided with a relatively long sheet, usually wound between supply and take-up reels.

There are two basic approaches which may be taken for advancing the sheet. In one approach, the photo-receptor sheet is advanced incrementally, and each incremental section of the sheet is used several hundred times in succession. After each section of the sheet has been used to make the maximum number of copies before it is no longer useable, the sheet is advanced so that a new section of it can be used during the next several hundred copy cycles. Following a single advance of the sheet from the supply reel to the take-up reel, with several hundred copies being made after each incremental advance, the sheet is replaced by a new one. In the other approach, the sheet is advanced incrementally during each copy cycle. After the sheet has been transferred from the supply reel to the take-up reel, it is transferred back in the reverse direction. Thereafter, successive copies are made once again as the sheet is advanced incrementally during each copy cycle from the supply reel to the take-up reel. Among the reasons for incremental photo-receptor belt advancement, for example of zinc-oxide material, is that it allows the photoreceptor belt to "dark adapt" before being reused. This eliminates copy quality variations which are quite noticeable on machines where a same frame is re-used several times per minute. After several hundred rewinds of the sheet, it is replaced by a new sheet.

One prior art patent which discloses an upwardly removable photoconductor is U.S. Pat. No. 3,883,240, which discloses a drum rather than a flexible photoconductor stored in a removable module. Some illustrative prior art patents which illustrate the use of intermediate webs as described above are: U.S. Pat. No. 3,737,230 dated June 5, 1973; U.S. Pat. No. 3,600,082 dated Aug. 17, 1971; U.S. Pat. No. 3,575,506 dated Apr. 20, 1971; and U.S. Pat. No. 3,617,124 dated Nov. 2, 1971.

In some of the machines of the type described above, when it is necessary to replace the photo-receptor sheet, a time-consuming service call is required. After the old sheet is removed, a new supply reel is placed in the machine and the leading edge of the photo-receptor sheet is threaded through the various rollers in the machine and attached to the take-up reel. Not only is this time consuming, but it is virtually impossible to train an operator to do the job himself even if a spare photo-receptor sheet on a supply reel is maintained on the user's premises. To overcome this problem, it has been proposed in the prior art, for example, in U.S. Pat. No. 3,617,124, to utilize replaceable cartridges so configured that threading of the sheet through the machine is not necessary. But this prior art machine is not practical for two reasons. First, the cartridge is not maintained stationary in the machine during a copy cycle, and instead reciprocates back and forth within the machine. This slows down the copy cycle. Second, it is necessary for the user to turn the cartridge around after the photo-receptor sheet has been advanced during successive copy cycles until the sheet is wound on the take-up reel. This is a serious disadvantage as it requires frequent user involvement in setting up the machine.

SUMMARY OF THE INVENTION

It is a general object of our invention to provide a highly compact photo-receptor sheet module which can be inserted in or removed from the copying machine in only a few minutes and even by an operator having only little training, the module remaining stationary in the machine and allowing tens of thousands of copies to be made without requiring any intervention on the part of an operator or the need for a service call in the absence of a malfunction.

In addition to the low per-copy cost, under 0.1 cent per copy for a 150-foot, 12-inch wide zinc-oxide sheet which is rewound 400 times in the illustrative embodiment of the invention, and is capable of making approximately 38,000 letter-size copies, there are numerous other advantages of our invention. In addition to mechanical simplicity and therefore increased reliability, it requires only a few minutes to replace one photo-receptor module by another. Toward the end of the useful life of the photo-receptor sheet in the machine, the user can order another module and have it on hand when replacement is necessary. The plug-in replacement of the module is so simple that it can be accomplished even by a user with a minimum of training being necessary. Even if a service call is required, it requires only minutes, rather than hours, to replace the module. Moreover, because the module is highly compact, it can be transported easily and the overall dimensions of the machine can be made relatively small. Another important advantage of the machine of our invention is that the rewinding of the photo-receptor sheet in the module is completely automatic, even to the extent that often the sheet is rewound without the user even being made aware of the fact; i.e., with no interruption in the ordinary use of the machine.

Briefly, in accordance with the principles of our invention, the photo-receptor module contains supply and take-up reels which are spaced closely together. The sheet is moved past various copying-step positions between the two reels along a path length which is considerably longer than the length of the minimum tangential line between the wound reels. The module is inserted from the top into the base section of the machine, and a considerable portion of the path through which the sheet moves during a copy cycle is in the downward and upward directions within the module. The various stations within the base section for accomplishing the steps in the copying process are arranged around the sheet path length. No threading of the sheet is required at all when a module is replaced; instead, one module is simply removed from the base section and another is substituted in its place.

Both the module and the base section contain respective gear and sprocket drive chain arrangements. When the module is inserted into the base section, a gear on the module engages a gear in the base section so that the drive for the module is automatically engaged to the drive in the base section without any additional steps being required to effect a mechanical interface. The control logic for the machine is for the most part contained in the base section. Electrical connectors are used to couple the electrical elements in the module such as clutches, switches, etc. to the logic in the base section; thus, uncoupling the connectors is all that is required to remove a module from the machine, and effecting the connections to a new module is all that is required from an electrical standpoint when inserting a new module.

One of the main objectives of our invention is to eliminate the need for frequent service calls. It is advantageous in this regard to thoroughly clean the section of the photo-receptor sheet which is used to make each copy; any toner not transferred to the copy paper and remaining on the sheet may show up in a subsequent copy made by use of the same sheet section. For this reason, we have developed a highly effective cleaning system for brushing off all untransferred toner from the photo-receptor sheet.

Recognizing that the photo-receptor sheet may exhibit optical fatigue as it is continuously used, we provide automatic compensation for this effect so that the quality of copies made on the machine does not change even after the photo-receptor sheet has been used several hundred times.

An indicator light is provided for informing the user when the time is approaching for a module replacement so that a replacement module can be ordered and thus be available as soon as it is needed.

Rewind of the photo-receptor sheet is automatic and requires no user intervention, and rewinding of the sheet takes place at high speed to minimize the downtime of the machine. A guide system is provided in the module for guiding the sheet accurately between the reels especially during the high-speed rewind, so that skewing of the sheet does not take place; this not only prevents jamming of the sheet within the module, it also prevents shortening of the useable life of the sheet due to fraying of the sheet edges.

These various features are only illustrative of those to be described below which contribute to the ruggedness of the machine, its highly compact configuration, its low per-copy cost, and its relatively service-free operation.

In the preferred embodiment of the invention, the photo-receptor sheet consists of conventional zinc-oxide coated paper and although this invention is primarily concerned with zinc-oxide coated intermediate webs, it does not preclude the use of other web substrates with any other electrographic coatings known to the arts. Such paper is not only readily available and inexpensive, but it functions adequately even under less than optimum conditions, e.g., with imperfectly "tuned" coronas. But it is to be understood that by the term "photo-receptor" sheet we mean to embrace any type of material, e.g., even organic, which can accomplish the charging, exposing, toner-developing and toner-transferring functions. It is also to be understood that while in the illustrative embodiment of the invention pre-cut sheets of copy paper are utilized, the invention is equally applicable to the use of copy paper rolls which are cut in accordance with the lengths of the original documents to be copied. In fact, even copy media other than copy paper may be utilized; we have found, for example, that excellent copies may be made on projection transparency materials.

Further objects, features and advantages of our invention will become apparent upon consideration of the following detailed description in conjunction with the drawing, in which:

BRIEF DESCRIPTION OF THE DRAWINGS

FIG. 4 is a schematic of the circuit contained in the box labeled by the numeral 221 in FIG. 3A;

FIG. 5 is a side view of the photo-receptor module;

FIG. 6 illustrates the path along which the photo-receptor sheet moves within the module;

FIG. 7 is a perspective view of the module;

FIG. 9 is a perspective view of the developer system incorporated in the machine;

FIG. 10 is a sectional view taken along the line 10—10 of FIG. 9;

DESCRIPTION OF THE PREFERRED EMBODIMENTS

DESCRIPTION OF MACHINE ELEMENTS — FIGS. 1 AND 2

Figure 1:
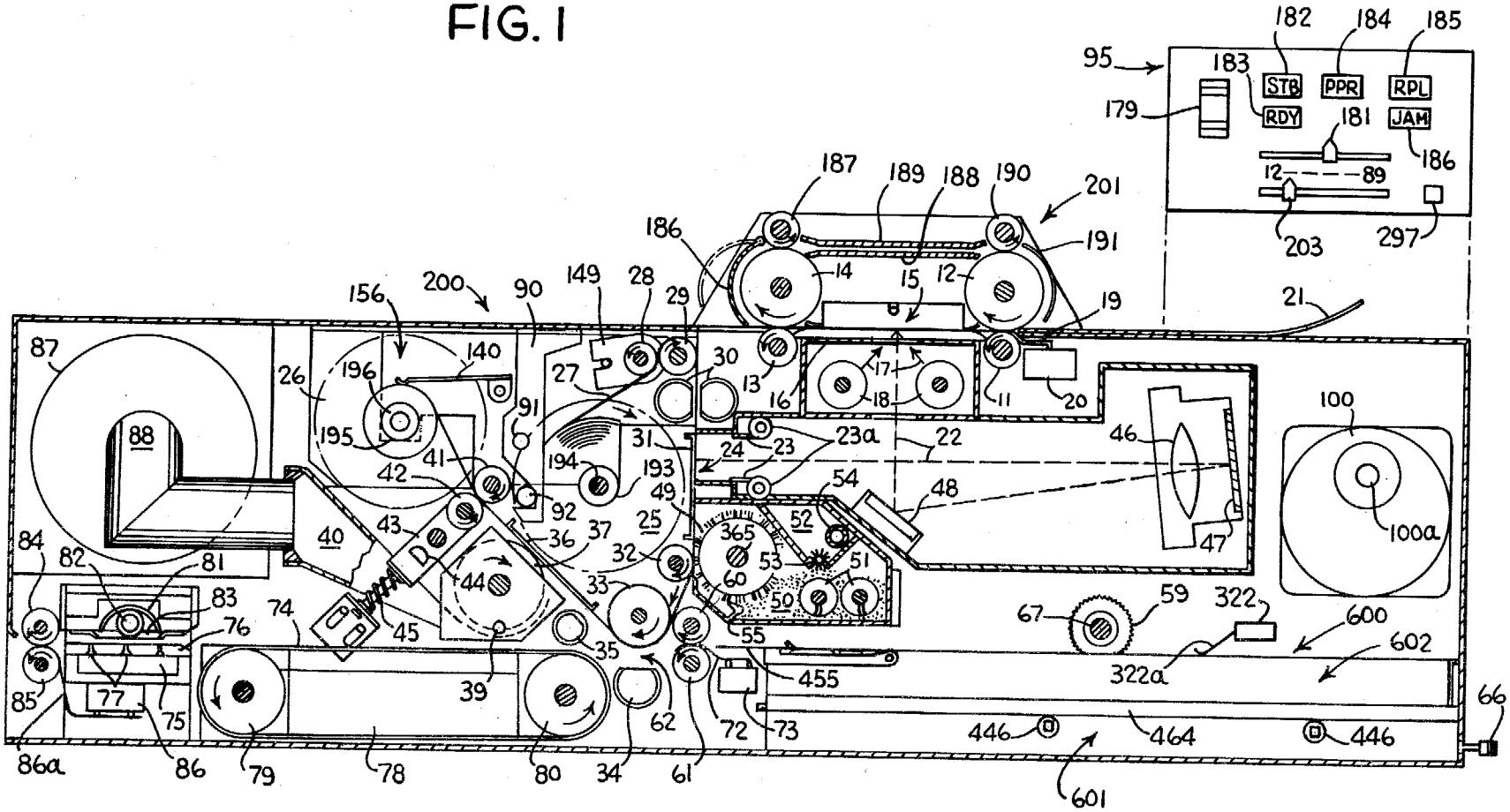
FIG. 1 is a sectional view through the copying machine of the invention looking at the front side thereof, and although omitting many elements does illustrate the relationships between the major sub-systems in the machine.

FIG. 1 depicts the various parts of the machine which control the making of copies. The sequence in which the elements operate will become apparent below in connection with the description of FIGS. 3A-3D, the electrical schematic of the machine. But before proceeding to a description of the precise sequence and timing of operations, it will be helpful to briefly review the functions of the elements depicted in FIG. 1.

Control panel 95, shown separated from the machine, is mounted on the upper right-hand corner of the base section of the machine. The control panel includes a main on/off switch 179, an exposure control lever 181, the position of the lever determining the exposure setting for lighter or darker copies as in conventional copying machines, and a multi-copy selector lever 203 for selecting between 1 and 9 copies to be made of an original document to be copied. The control panel also includes five indicator lamps designated respectively as STB, 182, standby; RDY, 183, ready; CPR, 184, copy paper required; RPL, 185, replace photo-receptor, and JAM, paper jam. Finally, the control panel includes a button 297 which when operated adds toner to the system as will be described below.

The copying machine includes a base section 200 and an original document transport section 201. The latter is made removable from the base section by employing conventional latching mechanisms not shown, as is known in the art. The base section includes an original input drive roller 11 and an original output drive roller 13, both of which turn continuously when power is turned on. The original document transport section 201 includes two pressure rollers 12 and 14 which bear against respective drive rollers. An original document, shown by the numeral 21, which is inserted into the machine is moved to the left in FIG. 1 between the nips of the two pairs of rollers. The leading edge of the original document bearing against finger 19 controls the operation of switch 20 to inform the machine logic that a new document is to be copied. The original document moves over exposure window 16 underneath a conventional-type pressure plate 15 which maintains the document flat against the window.

When the system is operated in the single-copy mode with lever 203 on the control panel being all the way to the left, turnaround guide 186 is in the position shown by the phantom lines. A slot is provided on the cover of transport section 201 to allow the guide to move to the upper position. With the guide in this position, the original document makes only a single pass over the exposure window. A collector tray may be provided as is known in the art for collecting successive original documents as they are fed through the machine.

When the system is operated in the multi-copy mode, turnaround guide 186 is maintained in the position shown in FIG. 1. In such a case, the original document is deflected upward. At the top of original document transport section 201, there are provided two pressure rollers 187 and 190 which bear against respective rollers 14 and 12. The original document is caused to move to the right at the top of section 201 between the two paper guides 188 and 189. The leading edge of the original document is then deflected by stationary turnaround guide 191 so that it enters the nip of input rollers 11 and 12 prior to the making of another copy. Once again, switch 20 is operated by the leading edge of the original document to inform the machine logic that an original document is about to be transported over the exposure window.

Lever 203 on the control panel is moved to a position other than to position 1, the leftmost position, when the machine is operated in the multi-copy mode. Whenever the lever is set to make more than one copy, a solenoid is operated which causes turnaround guide 186 to assume the position shown in FIG. 1. As each copy is made, as will be described in detail below, lever 203 moves one position to the left. As soon as it is moved all the way to the left, the single-copy mode position, the solenoid is released so that guide 186 is raised. At this time, the last copy is made and the original document exits from transport section 201.

A pair of matched exposure lamps 18 direct radiant energy toward the original document which passes over the exposure window 16, as shown by arrows 17. The reflected image energy, as shown by dotted line 22, is reflected from mirror 48, through objective lens 46 toward reflecting mirror 47. The radiant energy is then reflected from the mirror back through lens 46 toward image plane 24. The photo-receptor sheet moves downward in the image plane while making contact with grounded conducting plate 31. As is known in the art, the photo-receptor sheet, which originally is fully charged as will be described below, is exposed by the incident energy, with electrons on the sheet corresponding to light areas on the original document flowing from the sheet to grounded plate 31. The distance from exposure window 16 to lens 46 is the same as the distance from the lens to image plane 24; this ensures that the exposed image on the photo-receptor sheet is the same size as the original document.

A pair of shutter blades 23 is provided, each pivoted around a respective axis 23*a*. The two blades move inwardly toward each other under control of exposure control lever 181 on the control panel. The mechanical connection of the lever to the blades is not shown, as this type of construction is well known to those skilled in the art. The narrower the effective image area, the less the discharge of the photo-receptor sheet and therefore the darker the copy which is made.

The photo-receptor module as a whole is shown by the numeral 156. It is inserted into base section 200 from the top, the upper surface of the base section having a removable panel for allowing module 156 to be inserted into the machine or removed from it. The several removable panels required to gain access to the operative elements of the machine are not shown in the drawing inasmuch as the provision of removable panels in general on copying machines is well known to those skilled in the art. Although the photo-receptor module will be described in detail below, some of the operative elements are shown in FIG. 1.

In the base section of the machine there are two side plates, each having a cut-out 193 and a cut-out 195. In line with each of the supply reel and take-up reel shafts is a respective positioning bushing 194 or 196, on each side of the module. The two bushings on each side of the module fit tightly within the respective cut-outs for properly positioning the module 156 is the base section. On each side of the module, there is provided a locking lever 90 which is pivoted around a stud 91. The bottom of each locking lever is adapted to grip a locking stud 92 fixed to a side plate in the base section. As lever 90 in FIG. 1 is rotated slightly in the counter-clockwise direction, the lever is released from locking stud 92. As the lever is rotated in the clockwise direction, the lever tightly grips the locking stud. It is the release of the two levers which allows module 156 to be lifted out of the machine, and it is the tightening of the two levers which locks a replacement module securely in place.

The photo-receptor sheet 27 is wound between the supply and take-up reels. The supply reel is shown by the numeral 25 and the take-up reel is shown by the numeral 26. As the sheet leaves supply reel 25 it passes over pivot roller 29. A stabilizing roller 28 bears against roller 29. The stabilizing roller 28 is secured to the sides of module 156 by a pair of adjustable brackets 149. The brackets can be adjusted to control the pressure with which roller 28 bears against sheet 27 and roller 29. One such bracket 149 is shown only symbolically in FIG. 1, as techniques for adjusting a roller pressure are well known to those skilled in the art. On one side of module 156 the shaft of roller 28 terminates in a brake assembly as shown by the numeral 749 in FIG. 6. The brake assembly applies a torque to the shaft of roller 28 when it rotates in the counter-clockwise direction in FIG. 1, but it allows the shaft to turn freely in the clockwise direction. The purpose of the brake is to apply a drag on photo-receptor sheet 27 as it moves in the forward direction. The reason for this will become apparent below. But when the photo-receptor sheet is being rewound, there should be no drag on the sheet and for this reason the brake assembly applies a torque to the shaft of roller 28 when it rotates in only one of the two directions.

After the photo-receptor sheet moves over roller 29, it moves between the two primary coronas 30. The corona inside the module is positive; the corona in the base section is negative. As is well known in the art, the coronas apply a uniform electrostatic charge on the photo-receptor surface of sheet 27, this surface being disposed toward the reflected radiant energy 22. As the charged sheet moves past image plane 24, it is exposed as described above with electrons in areas corresponding to light areas on the original document being conducted away by grounded plate 31.

After the sheet leaves the exposure station, it moves past the developer station. The developer section includes a magnet brush 49 of a type generally known in the art. The developer section includes a developing mixture, consisting of electrostatic toner and magnetic particles, shown by the numeral 50. Mixing screws 51 continually mix the toner and magnetic particles. As magnetic brush 49 rotates, it picks up magnetic particles and toner carried by them. Doctor blade 55 is adjusted to control the amount of magnetic particles and toner which adheres to the magnetic brush. As the brush rotates, the toner particles are transferred to the charged areas on the photo-receptor sheet.

During the developing process, sheet 27 passes over grounded metallic roller 32. An electric field is maintained between the roller and the magnetic brush. As more and more copies are made, the ability of the photo-receptor sheet to discharge is degraded. Consequently, toward the end of the useful life of the sheet, more toner whould ordinarily be attracted toward the sheet by virtue of its higher charge and darker copies would result. To maintain a uniform copy quality throughout the life of the photo-receptor sheet, the bias potential on the brush is automatically increased depending upon the number of times that the photo-receptor sheet has been used. Initially, the developer brush is maintained at a potential of approximately −50 volts; this negative potential which attracts toner particles toward the brush in opposition to the attraction of the particles toward the photo-receptor sheet by its charge and prevents microscopic toner "dust" particles from settling on the sheet. The potential is gradually raised to approximately −150 volts toward the end of the useful life of the sheet; the greater the sheet usage, the higher the potential to compensate for the increased charge on the sheet. Although this changing bias potential is provided in the illustrative embodiment of the invention, we have found that satisfactory copies may be made without any bias potential at all, much less a varying potential.

As will be described in further detail below, the developer section includes a toner supply and a toner conveyor 54 which continuously furnishes toner to reservoir 52. Metering shaft 53 meters out toner from the reservoir to mixture 50 as it is required to replenish the mixture as toner is used up.

Sheet 27 continues to move over grounded metallic roller 33. A copy paper tray is provided at the bottom of the machine, on the right of FIG. 1. The various elements included in the copy paper tray will be described below. Feed roller 59 starts to turn at a time during a copy cycle such that the leading edge of a sheet of copy paper which is moved to the left bears against the leading edge of the exposed section of the photo-receptor sheet as the sheet turns around roller 33. Transfer corona 34 functions to cause the toner on the sheet 27 to be transferred to the copy paper in the transfer area shown generally by the numeral 62. The copy paper itself, after being moved initially by roller 59, is transported by copy paper feed roller 61 and pressure roller 60. In the path of the copy sheet there is a finger 72 mounted on switch 73. The switch is operated by the leading edge of the copy sheet for a purpose to be described below.

The photo-receptor sheet 27 continues to move past erase corona 35. This corona dissipates whatever charge remains on the photo-receptor sheet and facilitates subsequent cleaning off of toner particles from the sheet. The discharge is effected by moving the sheet over a grounded plate 36 which serves both as a sink for electrons which flow from the sheet 27 and as a backup plane for cleaning brush 37.

It is important that almost no toner remain on the sheet 27 because after it is rewound it must be clean prior to the making of additional copies. Brush 37 cleans off whatever toner particles remain on the sheet. A flicker bar 39 is provided to bend the bristles on the brush as they turn around the brush shaft. This flicking action causes the toner particles to be flicked off the brush bristles so that the toner particles are not reapplied to the sheet as the brush rotates. A vacuum duct 40 having a passage 38 draws off the toner particles into a tube and collector bag 88. The vacuum source for the bag is a motor 87 as shown in FIG. 1. Depending on the size of the collector bag employed, it should be replaced at periodic intervals. A removable panel on the machine may be provided for gaining access to the collector bag. It is advisable to change the collector bag whenever a new photo-receptor module is inserted in the machine.

After leaving the cleaning station, the photo-receptor sheet moves between drive roller 41 contained in module 156, and pressure roller 42 contained in base section 200. Roller 41 rotates continuously but does not function to move the photo-receptor sheet unless pressure roller 42 bears against it. Roller 42 is mounted on slide 43 which is biased by spring 45 into the engagement position. A camming shaft 44 is provided in the base section, the camming shaft passing through a slot in slide 43. As will be described below, it is the rotation of camming shaft 44 which determines whether pressure roller 42 is engaged with or is disengaged from roller 41 to control movement of the photo-receptor sheet.

Finally, the sheet 27 is wound up on take-up reel 26. As will be described below, when any copy is made the photo-receptor sheet moves only until the trailing edge of the exposed section passes the cleaning station. Generally speaking, during each copy cycle, the distance through which the photo-receptor sheet moves is from a point just at the top of primary coronas 30 to a point just to the left of the cleaning brush. Alternatively, the trailing portion of each used section of sheet 27 could be cleaned during the next copy cycle as it passes over brush 37, the trailing edge of the exposed section of sheet 27 thus stopping just past toner-transfer station 62.

After the copy sheet leaves the toner-transfer station, it is conveyed by rotating belts 74, as is known in the art. Several belts pass over drive roller 79 and idler roller 80. A blower 78 is provided to create suction underneath the copy paper so that it adheres to belts 74, the blower forcing air to flow out through the left end of the machine underneath the fuser section. The copy paper moves through the fuser section at the lower left end of the machine. Fuser lamp 82 generates the heat required for fusing the toner to the copy sheet, reflector 81 serving to direct the radiant energy against the imaged face of the copy sheet. The sheet moves below protective window 83 on top of sole plate 76, the function of which will be described below. The copy sheet is caused to adhere to the sole plate 76 by providing a series of ducts 77 in the plate in communication with vacuum chamber 75, the vacuum chamber being connected by a duct not shown to blower 78.

A switch 86 with a sensing finger **86*a* is provided at the output of the machine. As the fused copy sheet is transported out of the machine into a tray, not shown, between drive roller 85 and pressure roller 84, it causes switch 86** to operate for a reason to be described below.

Figure 2:
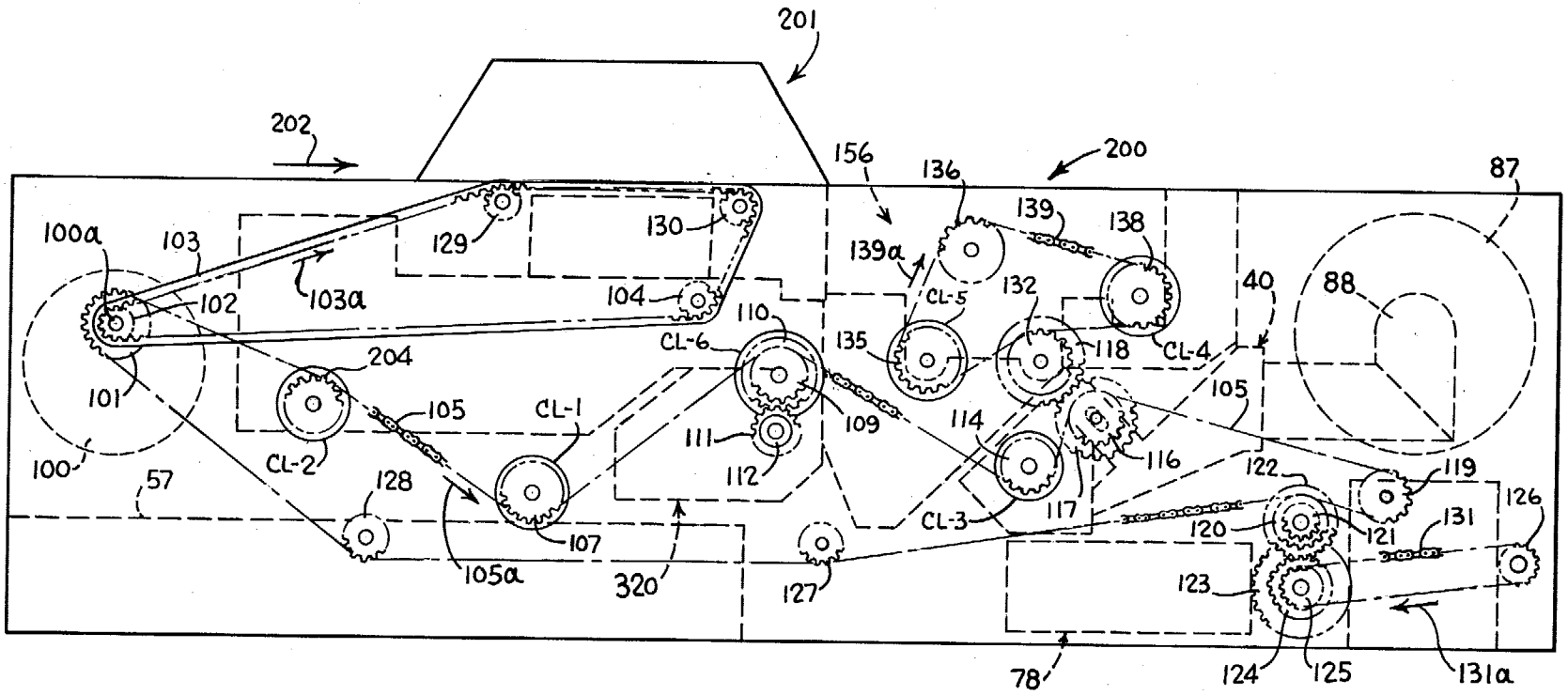
FIG. 2 is a view looking at the other side of the machine and illustrates the mechanisms for mechanically driving the various elements in the machine.

FIG. 2 depicts the other side of the machine and shows the manner in which the various shafts and rollers in the machine are driven. The main drive is provided by motor 100 when the main on/off switch 179 on control panel 95 of FIG. 1 in the on position. Motor drive shaft **100*a* causes drive sprockets 101 and 102 to turn continuously. Timing belt 103 is driven by sprocket 102 in the direction shown by arrow 103*a*. The timing belt passes over sprockets 129, 130, which are coupled to original document input rollers 11, 13. Sprocket 104 serves simply as a tensioning pulley for the belt 103. Rollers 11, 13 turn continuously so that any original document inserted in the machine is automatically transported. It is switch 20 of FIG. 1** which detects the leading edge of an original document and initiates the various logic operations.

Main drive chain 105 is driven by sprocket 101, the chain moving in the direction shown by arrow **105*a*. Sprockets 204 and 107 are driven continuously by the chain. Sprocket 107 is mounted on the shaft of copy paper drive roller 59 of FIG. 1, but the shaft and drive roller turn only when clutch CL-1 is operated as will be described below. Similarly, the operation of clutch CL-2 results in the turning of the shaft on which sprocket 204** is mounted, for a reason to be described below.

Drive chain 105 also causes sprocket 109 to turn continuously. This sprocket is mounted on the same shaft as gear 110, but the latter gear turns only when clutch CL-6 is operated. When the clutch is energized, gear 110 drives gear 111, this gear being mounted on the shaft of magnetic brush 49 of FIG. 1. Thus the magnetic brush turns only when clutch CL-6 is operated.

Sprocket 114 is mounted on the same shaft as cleaning brush 37 of FIG. 1. But the brush is driven only when clutch CL-3 is operated as will be described below. In general, the cleaning brush, blowers, exposure lamps, etc. must be controlled to operate at least during a copy cycle; although some of the copying-step functions can be carried out continuously, as a general rule this would simply waste power and wear out parts.

The drive chain 105 also causes drive sprocket 116 to turn continuously. Sprocket 116 is fixed to the same shaft as gear 117, and it is this latter gear which provides the mechanical power for the photo-receptor module. The module includes a gear 118 which engages gear 117 when the module is inserted in the base section. Gear 118 is fixed to drive sprocket 132 around which drive chain 139 passes. Thus when the photo-receptor module is inserted in the machine and power is turned on, drive chain 139 moves continuously in the direction shown by arrow **139*a***.

Drive chain 139 drives sprocket 135 which is fixid to the shaft which carries the photo-receptor supply reel. However, the supply reel is turned only when clutch CL-5 is operated. This clutch operates only during the time that the photo-receptor sheet is being rewound on the supply reel. Idler sprocket 136 simply serves as a tensioning device for chain 139. Sprocket 138, also driven by chain 139, is mounted on the shaft of the take-up reel. But the take-up reel is driven only when clutch CL-4 is operated. This clutch is operated during each copy cycle when the photo-receptor sheet must be advanced in an incremental step in the forward direction. Although the take-up reel is thus driven, it does not control movement of the photo-receptor sheet. The coupling between clutch CL-4 and the reel shaft is too loose to permit the take-up reel to actually pull off the sheet from the supply reel. Instead, the take-up reel simply serves to take up or wind up whatever length of the sheet is caused to move by other means.

The actual drive for the sheet is accomplished by roller 41 of FIG. 1. This roller is secured to the shaft of gears 118, 132 and is thus driven continuously when power is on. But as described above, roller 41 serves to drive the photo-receptor sheet only when pressure roller 42 in the base section of the machine is forced up against the sheet.

Referring back to main drive chain 105, after passing over sprocket 116 the chain passes over idler sprocket 119 which simply serves as a tensioning device. The chain then passes over sprocket 120. This sprocket is secured to gears 121 and 122 so that all three of them turn together. Gear 122 drives gear 124 which is secured to the shaft of belt drive roller 79 of FIG. 1. Thus belts 74 turn continuously when power is turned on. Gears 123 and 125 are secured together and are mounted on the same shaft as gear 124. But gears 123 and 125 move independently of gear 124. Gear 123 is turned by gear 121, which thus in effect provides the drive for gear 125. The latter gear drives chain 131 in the direction of arrow 131*a* to turn sprocket 136. Sprocket 136 is secured to the shaft of output roller 85 of FIG. 1 which functions to eject the copy sheet from the machine.

Main drive chain 105 also drives sprocket 127 which is secured to the shaft of roller 61. This is the roller of FIG. 1 which controls the transport of a copy sheet past the toner transfer station. Idler sprocket 128 simply serves as a chain tensioning device.

Figure 3A:
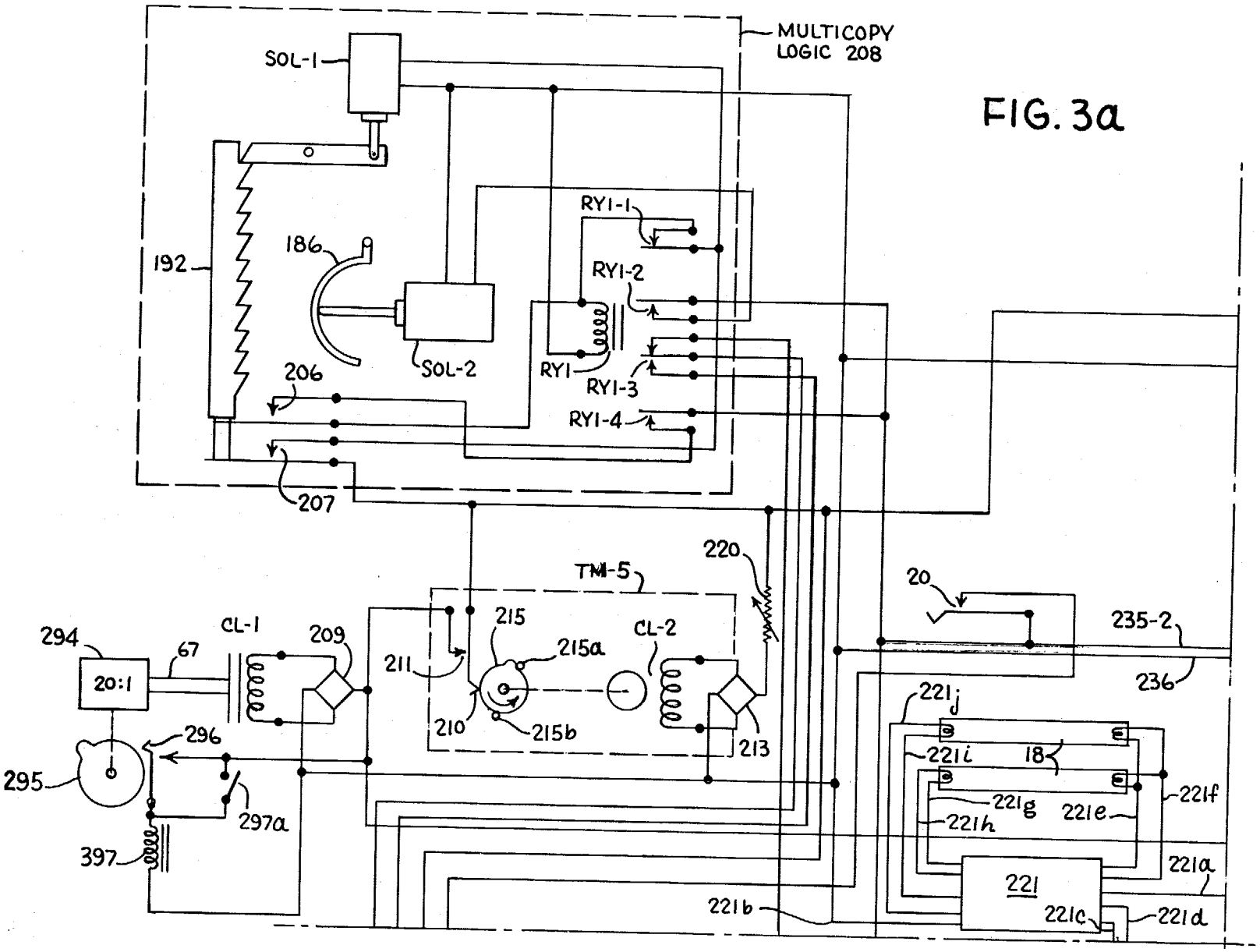
FIGS. 3A–3D, arranged as shown in FIG. 3E, depict the logic circuit for controlling the various machine operations.

With this brief description of the functions of the various elements shown in FIGS. 1 and 2 in mind, the operations of the machine can be best understood with reference to FIGS. 3A–3D, arranged as shown in FIG. 3E, and FIG. 4, which together depict the electrical system of the machine.

DESCRIPTION OF ELECTRICAL SYSTEM AND SEQUENCE OF OPERATIONS — FIGS. 3A–3E AND FIG. 4

Figure 3B:
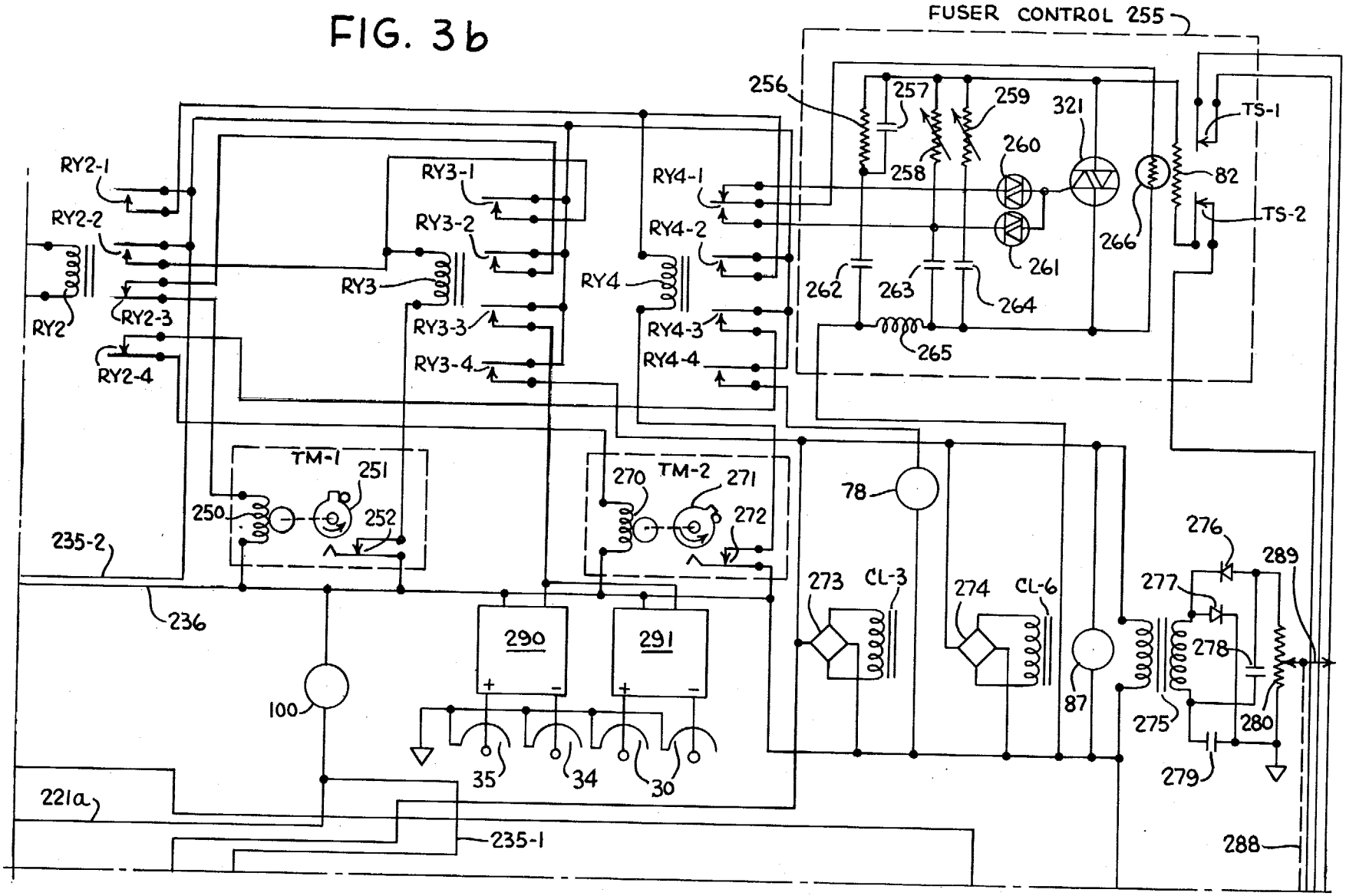
Figure 3C:
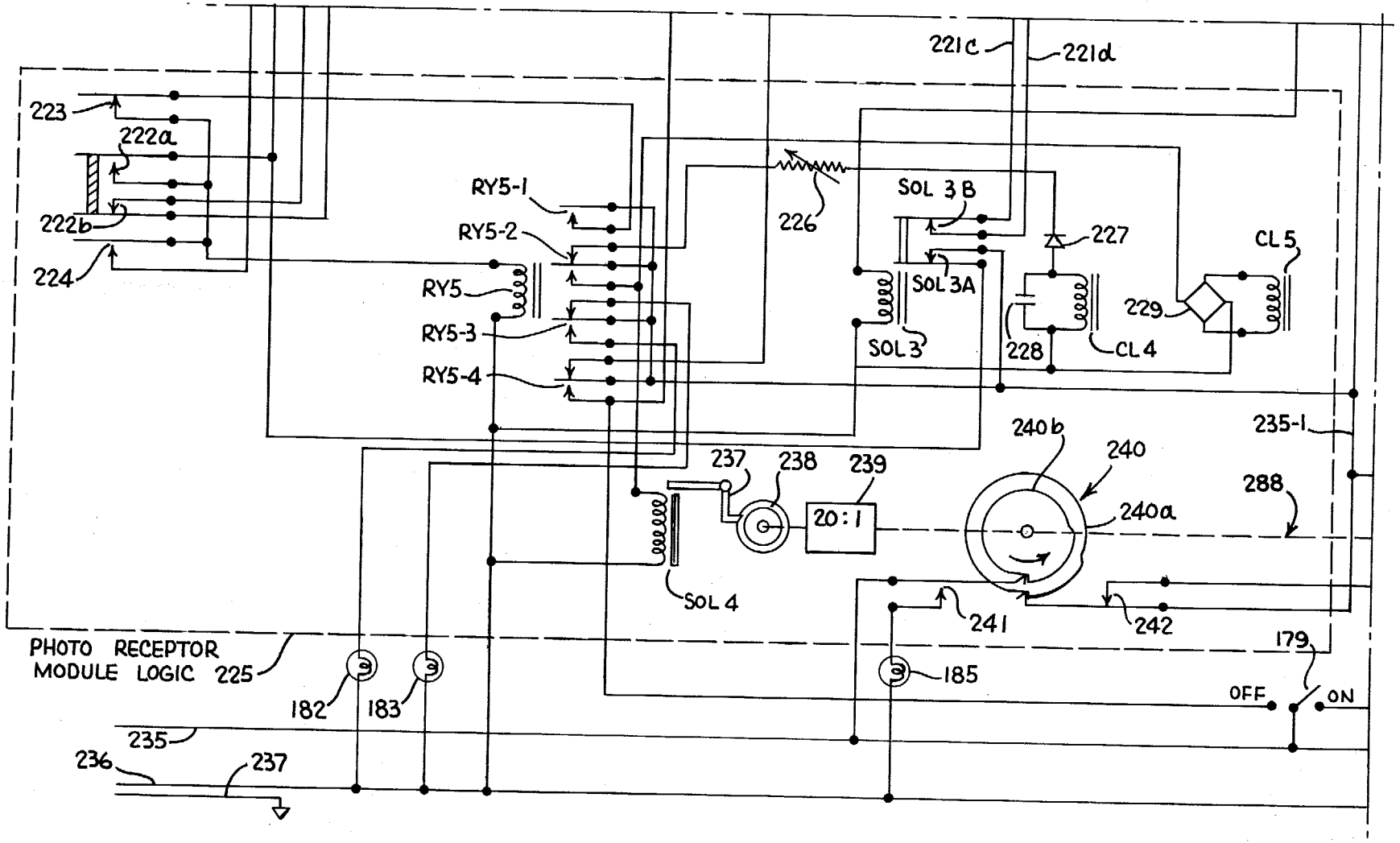

Power is supplied to the copying machine over conductors 235 and 236 of FIG. 3C. Conductor 237 furnishes the earth ground from the wall socket to the frame of the base section of the machine. The earth ground on the frame of the base section is applied to the photo-receptor module by virtue of the fact that the frames of the two units are made of metal and the module is plugged into the base section. As shown in FIG. 3B, the only electrical components connected to the machine frame are the corona shields in the photo-receptor module and the base section, and the lower end of potentiometer 280 in the base section. Other than these connections, the various electrical components are connected between conductor 236 which serves as the system "common" and conductor 235 which serves as the "hot" line.

Even with the main on/off switch 179 in the off position, some of the line current flows through fuser lamp 82, as will be described. Sole plate 76 of FIG. 1 is thus maintained in a "stand-by" semi-heated condition at all times. This allows the machine to "warm up" much faster immediately after the main power switch 179 is turned on. That is, by maintaining the sole plate in the fuser station pre-heated at all times, the first copy may be made very soon after the main power switch is turned on.

Power conductor 236 is connected directly through filter inductor 265 to the cathode of Triac 321. Even when the main on/off switch 179 is in the off position, power conductor 235 is connected through normally-closed thermal switch TS-2 and the filament of fuser lamp 82 to the anode of the Triac. Thermal switch TS-2, in thermal contact with sole plate 76, opens only if the temperature exceeds a maximum "safe" level, thereby cutting off power to lamp 82. Consequently, the fuser lamp is operated depending upon when during each half cycle of the line current the Triac is turned on. The control terminal of the Triac is connected to each of Diacs 260, 261. When the main power switch is in the off position it is Diac 260 which controls the firing of the Triac during each half cycle. While the Triac is off during the first part of each half cycle, the line voltage appears across thermistor 266 and potentiometer 259 connected in series by the normally closed contacts RY4-1, with the junction of the two elements being connected to one end of Diac 260. The thermistor 266 is connected across capacitor 264 by the normally closed contacts RY4-1. The thermistor and the potentiometer form a voltage divider, with the potential across the thermistor controlling the firing angle of the Triac during each half cycle. The thermistor is in thermal contact with fuser sole plate 76 (FIG. 1). If the standby temperature of the sole plate increases beyond the desired pre-set standby level, the impedance of the thermistor decreases and a smaller percentage of the total voltage drop appears across the thermistor to delay the firing time of the Triac. Conversely, if the temperature falls below the pre-set value, a greater percentage of the total voltage appears across the thermistor and the Triac fires earlier during each half-cycle. The thermistor functions as a feedback device to maintain the sole plate at the proper standby temperature. This pre-set temperature level is controlled by an initial adjustment of potentiometer 259. Capacitors 257, 262, 263 and 264, resistor 256, and inductor 265 in fuser control 255 on FIG. 3B simply serve as filter elements as is known in the art to prevent the Triac firing pulses from being fed back to the power line.

Thermal switch TS-1 is normally closed whenever the line cord is connected to the wall socket; it closes when the temperature of the sole plate is at or above the standby temperature. This switch must be closed in order for any copies to be made. Consequently, when the power cord is first connected to a wall socket, even if switch 179 is immediately turned on, the machine cannot operate until after the sole plate has reached the standby temperature at which time thermal switch TS-1 closes. But as soon as the thermal switch closes, and if the main power switch 179 is in the on position, line conductor 235 is connected through switch 179, thermal switch TS-1, the normally closed contacts RY8-1 and switch 242 to conductor 235-1. Switch 242 is normally closed; as will be described below it opens only after the photo-receptor sheet has been rewound 400 times. But as long as it is not time to replace the sheet, conductor 235-1 is energized. This conductor is connected through the normally closed contacts RY5-3 to one end of the filament of ready lamp 183. The other end of the filament is connected to power line 236. Consequently, the lamp lights up to indicate that the machine is ready to make a copy. As long as the power cord is connected to the wall socket, the ready lamp energizes as soon as the main on/off switch 179 is turned on. There is a short delay, to allow the fuser sole plate to reach the standby temperature, only if the line cord has been unplugged previously.

Power conductor 236 is connected directly to one terminal of motor 100. The other end of the motor is connected to conductor 235-1. Consequently, as soon as the main on/off switch is operated, provided that thermal switch TS-1 is in its normally closed position so that power can be extended through switch 242 to conductor 235-1, motor 100 starts to operate. This is the main drive motor for timing belt 103 and drive chain 105 in FIG. 2. The timing belt and the chain thus start to drive the various sprockets to which they are coupled.

Conductor 235-1 is also connected via conductor 221*a* to ballast transformer circuit 221. Power conductor 236 is also connected to this circuit by conductor 221*b*. The ballast transformer circuit serves to energize exposure lamps 18 from the power conductors as soon as contacts SOL-3B close which takes place when an original document is fed into the machine as will be described shortly.

The ballast transformer circuit 221, although shown in detail in FIG. 4, is a standard circuit well known in the art. Conductors 221*a* and 221*b* are connected across the power line and thus a potential of 110 volts appears across the middle section of the primary winding of the transformer. The voltage across the entire primary winding is approximately 350 volts and the voltage across each of the secondary windings, as well as the voltage across the bottom part of the primary winding, is approximately 3 volts.

The two secondary windings and the bottom part of the primary winding are connected via conductors 221*e* through 221*j* to the four filaments of the exposure lamps 18, there being two filaments in each exposure lamp. The filaments glow continuously whenever the machine in on. However, the gas in the lamps ionizes only when the 350-volt potential is applied across the two lamps in series, that is, the exposure lamps turn on only when the high potential is applied to them. The filaments are made to glow continuously only to permit a rapid turn-on.

When conductors 221*c* and 221*d* are connected together through contacts SOL-3B of solenoid SOL-3, the full 350-volt potential appears across the two lamps connected in series. As is known in the art, the two lamps stay on continuously, the filaments in each lamp switching between anode and cathode functions as the line voltage changes direction.

The ballast transformer circuit includes two capacitors, one across one lamp for starting purposes, and the other in series with the lamps in order to limit the peak current. The details of the ballast transformer circuit are not important for an understanding of the present invention, it being understood that what is required is the turning on of the exposure lamps with the operation of solenoid SOL-3.

When an original document is fed into the machine, switch 20 of FIGS. 1 and 3A, whose sensing finger 19 that is positioned at the nip of input rollers 11 and 12, closes. One end of the switch is connected to conductor 235-2 which is connected through the normally closed contacts RY5-4 to power conductor 235-1. The other end of the switch is connected through normally-closed contacts 222*b*, potentiometer 220 and rectifier 213 to power conductor 236; this end of switch 20 is also connected through contacts 222*b* and the winding of relay RY2 to the same power conductor. Consequently, as soon as the leading edge of the original document is sensed, relay RY2 operates and clutch CL-2 connected across rectifier 213 energizes. Potentiometer 220 is set to provide the correct rectifier output for energizing clutch CL-2. When clutch CL-2 operates, cam 215 is rotated, power being derived from drive chain 105. As the cam turns in the counter-clockwise direction, it engages finger 210 to close contacts 211. When this happens, clutch CL-1 operates, as will be described below, to initiate the feed of a sheet of copy paper. The elements included in box TM-5 constitute a timing circuit to control the proper initiation of copy paper feed; the copy paper starts to move at a time during the overall cycle, as determined by the shape of cam 215, so as to control the synchronization of the leading edge of the copy paper with the leading edge of the section of the photo-receptor sheet which is imaged during the copy cycle.

The operation of relay RY2 initiates several operations in the system. When contacts RY2-2 close, one end of the winding of relay RY-3 is connected through the contacts to power conductor 235-2. The other end of the winding of relay RY3 is connected through normally-closed contacts 252 to power conductor 236. Consequently, relay RY3 energizes. Since the energization of relay RY2 is controlled by the closing of switch 20, and this switch opens as the trailing edge of the original document passes through the input rollers 11, 12, relay RY2 releases at that time. It is necessary, however, to ensure that relay RY3 remains energized even after relay RY2 releases. For this reason, contacts RY3-1 are provided to latch relay RY3. The upper end of the relay winding is extended through contacts RY3-1 to power conductor 235-2. Thus relay RY3 remains energized even after relay RY2 releases.

In a similar manner, the initial operation of relay RY2 causes relay RY4 to energize, this latter relay also being provided with its own latching contacts. One end of the winding of relay RY4 is connected through normally-closed contacts 272 to power conductor 236. The other end of the relay winding is connected through contacts RY2-1 to power conductor 235-2. Consequently, relay RY4 energizes together with relay RY2. The upper end of the winding of relay RY4 is also connected through normally-open contacts RY4-2 to power conductor 235-2. Thus as soon as contacts RY4-2 close, relay RY4 remains energized, even after relay RY2 releases.

The energization of relay RY3 causes the various corona supplies to turn on. Power conductor 235-2 is connected through contacts RY3-3, as soon as they close, to one of the inputs of each of corona supplies 290 and 291. The other input of each corona supply is connected to power conductor 236. Thus as soon as relay RY3 energizes, both corona supplies are turned on. Each of the several coronas is provided with a grounded shield, as shown and as is known in the art. Corona supply 291 operates the two primary coronas 30, arranged in FIG. 1 so that the photoreceptor face of sheet 27 is charged with electrons. Corona supply 290 energizes coronas 34 and 35. Corona 34 is a negative corona so that toner particles on sheet 27 will be attracted toward the copy paper as shown in FIG. 1. Corona 35 is positive so that any remaining charge on sheet 27, following the toner-transferring station, may be "erased".

At the same time that the coronas are turned on, the photo-receptor sheet 27 starts to move. This will be described in greater detail below, but at this point it is sufficient for an understanding of the electrical system of the machine to note that it is the operation of solenoid SOL-3 that causes roller 42 in FIG. 1 to move up against roller 41 with sheet 27 between them so that the latter roller can drive sheet 27. Power conductor 235-2 is connected through the normally-open contacts RY3-4 to the upper end of the solenoid winding. The lower end of the winding is connected directly to power conductor 236. Consequently, solenoid SOL-3 energizes with the operation of relay RY3, and the photo-receptor sheet starts to move as soon as the leading edge of the original document is detected.

One end of the input of rectifier 274 is connected directly to power conductor 236. The other end is connected through contacts RY3-4 to power conductor 235-2. Thus rectifier 274 is energized when relay RY3 operates to supply power to clutch CL-6. This is the clutch, as shown on FIG. 2, which drives the developer system.

In an identical fashion, power is supplied to rectifier 273 at the same time for energizing clutch CL-3. This is the clutch, as shown on FIG. 2, which controls the drive of the cleaning brush. Motor 87 is also connected between conductor 236 and contacts RY3-4. Thus this motor as shown in FIG. 1, which supplies the vacuum for the cleaning system, also starts to operate as soon as the leading edge of an original document is detected.

It will be recalled that metallic roller 32 of FIG. 1 is grounded; the developer system is biased, as described above, to provide a variable electric field for the photo-receptor sheet. Transformer 275, diodes 276 and 277, capacitors 278 and 279, and potentiometer 280 comprise a conventional voltage doubler for deriving a D.C. potential from an A.C. source. The primary winding of the transformer is connected between conductor 236 and contacts RY3-4. Consequently, the energization of relay RY3 results in current flowing through the primary winding and the derivation of a bias potential for the developer system across potentiometers 280. The tap of the potentiometers is connected by conductor 289 to the developer system, as will be described below.

The greater the number of copies already made with sheet 27, the larger the negative bias potential which should be used to compensate for optical fatigue of the sheet. Cam 240 is incremented during each rewind operation, and thus its angular position represents a measure of the bias potential which is required. The cam is mechanically coupled by a shaft shown symbolically by the numeral 288 to the potentiometer tap; the tap is moved upward to increase the bias potential as the sheet 27 is used repeatedly.

It will be recalled as shown in FIG. 2 that clutch CL-4 loosely couples sprocket 138 to the take-up reel in the photo-receptor module. Although the take-up reel is not driven with sufficient torque to draw sheet 27 from the supply reel, it is driven with sufficient torque to take up whatever portion of the sheet is driven by rollers 41, 42. Clutch CL-4 of FIG. 3C energizes immediately when the main power switch 179 is turned on; there is no reason to delay its operation. One end of the winding of clutch CL-4 is connected directly to power conductor 236. The other end is connected through diode 227, variable resistor 226 and the normally-closed contacts RY5-2 to power conductor 235-1. Consequently, as soon as the main on/off switch is turned on, clutch CL-4 operates. Potentiometer 226 is adjusted to provide a sufficiently weak coupling so as to take up the slack in the photo-receptor sheet without actually driving it. Although diode 227 causes current to flow from the power line through the clutch winding only during alternate half cycles, capacitor 228, which is connected across the winding, ensures that the clutch remains energized for as long as main switch 179 is in the on position.

The initial energization of relay RY3 controls the operations of the several elements described above, all of which cease to operates, as will be described below, when contacts 252 open. The initial energization of relay RY4 controls other operations in the fuser section of the machine, which operations eventually terminate when contacts 272 open. The reason that two separate relays are provided is that the fuser functions are the last to be turned off. Accordingly, relay RY3 can be released earlier than relay RY4, as will be described below.

When relay RY4 first energizes, motor 78 is turned on. One end of the motor is connected to power conductor 236, and the other end is connected through normally-open contacts RY4-4 to power conductor 235-2. The motor thus turns on when relay RY energizes. Motor 78 is the fuser vacuum motor as shown in FIG. 1 which provides the suction for maintaining the copy paper against belts 74 and sole plate 76.

Although the fuser lamp is operated at the standby level even before the leading edge of an original document is sensed, the lamp must be operated at a high level when a new copy is to be made. It will be recalled that the time during each standby half-cycle when Triac 321 operates is determined by the setting of potentiometer 259. But when a copy is to be made, it is potentiometer 258 which controls the time during each half-cycle when Triac 321 fires. When relay RY4 energizes, the normally-closed contacts RY4-1 open and the normally-open contacts RY4-1 close. With the opening of the normally-closed contacts, thermistor 266 is no longer connected to the junction of potentiometer 259 and Diac 260. Instead, the normally-open contacts now close to connect the thermistor to the junction of potentiometer 258 and Diac 261. It is now the setting of potentiometer 258 which controls the firing of Triac 321. This potentiometer is adjusted so that the Triac fires earlier during each cycle to increase the heat generated by fuser lamp 82. The thermistor still serves in a feedback capacity to ensure that the fusing function is maintained at a constant temperature. But this constant temperature is determined by the setting of potentiometer 258. It should be noted that as soon as the thermistor is switched into the circuit of Diac 261, the Triac conducts almost continuously because the resistance of the thermistor is relatively high. It is only as the temperature increases to the desired fusing level and the resistance of the thermistor decreases, that the thermistor functions to permit a constant temperature at the desired fusing level. The sole plate reaches the desired high temperature between the time that the original document is first sensed and the time that the copy sheet reaches the fuser section of the machine.

Should the thermistor fail to control the temperature in the fusing station, there may be excessive heating; this is to be avoided. It is for this reason that thermal switch TS-1 is provided. This switch is connected in series with main on/off switch 179. Although the switch is normally maintained closed, should the fusing area temperature exceed the maximum safe level, switch TS-1 opens and in effect power is shut off. This is a desirable feature in that it minimizes the hazard of a fire.

It will be recalled that solenoid SOL-3 energizes with the operation of relay RY3 as soon as the leading edge of the original document is detected. When the solenoid energizes, contacts SOL-3B close. It is the closing of these contacts, as described above, that results in the turning on of exposure lamps 18. The opening of contacts SOL-3A at the same time serves another function, which will be described below.

Although the photo-receptor sheet starts to move as soon as the leading edge of the original document is detected, the copy paper starts to move later on in the cycle; the copy paper has a shorter distance to travel to transfer area 62 of FIG. 1 than does the leading edge of that portion of the photo-receptor sheet which is exposed. As described above, clutch CL-2 in timer TM-5 energizes as soon as the leading edge of the original document is detected. But it is only after finger 210 has been moved by the camming surface on cam 215 that contacts 211 close. The closing of contacts 211 establishes a connection of one input of rectifier 209 through contacts **222*b* and switch 20 to power conductor 235-2. The other input to the rectifier is connected to power conduction 236. Thus as soon as contacts 211 close, clutch CL-1 operates. Referring to FIG. 2, it is the operation of this clutch which causes copy paper feed roller 59 of FIG. 1** to start turning.

The reason for providing variable resistor 220 in the circuit for clutch CL-2 is that the energizing current should be limited to a value which drives cam 215 but allows stop **215*b* to stop the cam without the clutch overheating. The cam is prevented from continuing to turn with contacts 211 remaining open even though clutch CL-2 is still energized. It is not until the clutch is released that the return spring returns cam 215 to the starting position adjacent stop 215*a***.

As the trailing edge of the original document passes by finger 19 of FIG. 1 and switch 20 opens, relay RY2 and clutch CL-2 release. With the release of clutch CL-2, spring-loaded cam 215 returns to its original position as shown in FIG. 3A, and clutch CL-1 releases.

There is no danger of switch 20 opening before the copy sheet reaches the input nip of rollers 60 and 61 of FIG. 1 because if the original document is long enough to bridge roller pairs 11, 12 and 13, 14 which it must be if the original document is to be transported through section 201 of the machine in the first place, then clutch CL-1 remains energized long enough to ensure that the leading edge of the copy paper reaches rollers 60, 61.

Original documents should not be fed in immediately after each other. Clutch CL-2 releases when switch 20 senses the trailing edge of an original document. If the clutch does not release because in effect no trailing edge is sensed when there is no space between successive original documents, cam 215 is not allowed to return to its starting position, and simply remains blocked by stop **215*b*. Clutch CL-1 is pulsed only once, and only one copy sheet would be processed through the machine. This is a desirable feature in that it prevents jams in the fuser area. There must be a time gap of approximately 30 milliseconds between the sensing by switch 20** of the trailing edge of one document and the leading edge of another in order for clutch CL-2 to release and for successive copies to be made.

It is the trailing edge of the original document which actually determines when the various elements in the machine turn off or stop turning; the various functions must be performed no matter how long the original document. After the trailing edge of the original document is detected, enough time must be allowed for the trailing edge of the section of the photo-receptor belt being operated upon to move all the way past cleaning brush 37 of FIG. 1. Timer TM-1 of FIG. 3B controls the cessation of various functions at a pre-set time following the passing of the trailing edge of the original document past finger 19 of switch 20.

Before an original document is fed into the machine, both of relays RY2 and RY3 are released. Although one end of the winding of timing motor 250 is connected to power conductor 236, the other end of the winding is connected through normally-closed contacts RY2-3 and normally-open contacts RY3-2 to power conductor 235-2. Consequently, motor 250 does not operate. When the leading edge of the original document is detected, both relays are energized. It is now open contacts RY2-3 which prevent motor 250 from operating. But as soon as relay RY2 releases with the sensing of the trailing edge of the original document and contacts RY2-3 close, since contacts RY3-2 remain closed because relay RY3 is latched, motor 250 starts to operate. With the operation of motor 250, cam 251 starts to turn in the counter-clockwise direction against its spring bias.

In a similar manner, one end of motor 270 in timer TM-2 is connected to power conductor 236, while the other end of the motor is connected through contacts RY2-4 and RY4-3 to power conductor 235-2. One or the other of these contacts is open prior to the feeding in of an original document and during that time that switch 20 is operated by the original document passing over finger 19. But as soon as relay RY2 releases, and both contacts RY2-4 and RY4-3 are closed, motor 270 starts to operate and cam 271 is turned in the counter-clockwise direction against the force of its bias spring.

Assuming that another original document is not fed into the machine, timer TM-1 times out after the trailing edge of the exposed section of the photo-receptor sheet has moved past the cleaning station. When the camming surface on cam 251 causes contacts 252 to open, relay RY3 releases. All functions activated by this relay which are movement of the photo-receptor sheet, and operations of the coronas, exposure lamps, cleaning vacuum, cleaning brush, developer system and developer system bias now cease. With the release of relay RY3, motor TM-1 ceases to operate and cam 251 returns to its initial position.

Timer TM-2, however, continues to operate. It must allow sufficient time for the copy paper to emerge from the fuser output rollers 84 and 85 of FIG. 1 before timing out. But when contacts 272 eventually open, relay RY4 releases; the fuser is restored to its standby temperature and vacuum motor 78 turns off. With the release of relay RY4, motor 270 ceases to operate and cam 271 returns to its initial position.

If another original document is fed into the machine before timing motor TM-2 has timed out, or even if another original document is fed into the machine before timing motor TM-1 has timed out, switch 20 closes once again and relay RY2 energizes. With the energization of relay RY2 and the opening of contacts RY2-3 and RY2-4, both timing motors 250 and 270 cease to operate and the two cams return to their starting positions. The various functions controlled by relays RY3 and RY4 simply continue to be performed or are reinitiated. From a timing point of view, the only thing which must be controlled is the start of the copy paper feed. Since it is the closing of switch 20 which first operates clutch CL-2, it is apparent that the copy paper feed always begins at the correct time relative to the movement of the leading edge of the original document. Whether or not the photo-receptor sheet stops moving, depending upon how long a time elapses between the feeding in of original documents is not important. As long as the photo-receptor sheet moves with the transport of the original document over the scanning window, the leading edge of the exposed section of the photo-receptor sheet will reach toner transfer area 62 at the same time that the leading edge of the copy paper reaches this area.

When more than one copy is to be made of an original document, lever 203 on control panel 95 is moved to the number of copies desired. There is a direct coupling between this lever and ratchet 192 in the multi-copy logic 208, the ratchet moving upward in FIG. 3A a number of positions in accordance with the number of copies required. Although contacts 206 and 207 are open when single copies are being made, these contacts are closed whenever more than one copy is indicated by lever 203.

As soon as the original document is fed into the machine and switch 20 closes, a connection is established from power conductor 235-2 to one end of the winding of solenoid SOL-1 through switch 20, and contacts **222*b* and 207. The other end of the solenoid winding is connected directly to power conductor 236. Consequently, the first operation of switch 20 causes the solenoid to operate, the solenoid releasing only after the trailing edge of the original document passes by finger 19, thereby releasing switch 20. The initial operation of solenoid SOL-1 results in the movement of rachet cam 192 back one position toward the single-copy position. At the same time lever 203** on the control panel moves one position to the left.

With the first closing of switch 20, a connection is also established from power conductor 235-2 through contacts **222*b* and 207, and normally closed contacts RYl-1 to one end of the winding of relay RY1. The other end of the relay winding is connected to power conductor 236. Consequently, relay RY1 energizes. Although solenoid SOL-1 releases as the trailing edge of the original document passes by the input switch, relay RYl does not. The relay remains latched over its contacts RY1-4 and contacts 206. As long as relay RYl remains latched, solenoid SOL-2 is energized, current flowing from power conductor 236 through the solenoid winding and contacts RY1-2 to conductor 235-2. It is when solenoid SOL-2 is operated that turn-around guide 186 assumes the position shown in FIG. 1**.

There need not be a physical connection between the solenoid shaft and the turn-around guide, as is shown symbolically in FIG. 3A. When the solenoid is operated, its shaft may be pulled inward. Thus the solenoid, which is in the base section of the machine, has its shaft extending upwardly when it is de-energized, and the upwardly extending shaft may simply push the turn-around guide upward. It is only when the solenoid is energized that the shaft is withdrawn so that the turn-around guide can rotate downwardly under the force of gravity. This arrangement facilitates the removal of original document transport section 201 from base section 200 of the machine. Alternatively, the solenoid may be contained in section 201, with an electrical connector being provided to connect the solenoid to the logic in the base section.

With the turn-around guide in the position shown in FIG. 1, the original document is fed upward as described above in connection with FIG. 1. The original document travels in a loop and its leading edge once again operates switch 20. All of the machine operations are as described above in connection with the making of a single copy. While multiple copies are being made, relay RY1 and solenoid SOL-2 remain latched. Solenoid SOL-1, however, operates each time that the leading edge of the original document reaches switch 20. Each time that this happens, ratchet 192 is returned one position toward the single-copy position.

At the start of the making of the last copy, the ratchet 192 is returned to the single-copy position as soon as the leading edge of the original document is sensed and solenoid SOL-1 operates for the last time. Both contacts 206 and 207 now open. The latching path for relay RY1 is thus broken and solenoid SOL-2 de-energizes. Turn-around guide 186 is forced upward before the original document reaches rollers 14 and 16 in transport section 201. While the last copy is made, the machine functions exactly as it does in the single-copy mode.

During the making of multiple copies, neither of timing circuits TM-1 and TM-2 times out. Each time that switch 20 operates, relay RY2 energizes, contacts RY2-3 and RY2-4 open, and cams 251 and 271 return to their starting positions. The various machine systems remain on continuously, and the photo-receptor sheet moves continuously. But as described above, all that is required for proper synchronization is that clutch CL-2 first operate whenever switch 20 detects the leading edge of the original document to be copied. And this takes place in the multi-copy mode since the original document is continuously returned to the input nip of rollers 11 and 12, and each time that it is so returned timer TM-5 starts to operate.

The photo-receptor module includes three switches 222, 223 and 224 for sensing the wound sheet on the supply and take-up reels. These sensing switches will be discussed in further detail below. But for an understanding of the electrical system, it is only necessary to consider what it is that the switches detect. Switch 222 senses the almost full winding of the photoreceptor sheet on the take-up reel except for the end section which extends through the module to the hub of the supply reel and enough of the sheet to complete a copying cycle in progress. Switch 222 operates, contacts **222*a* close and contacts 222*b* open only after practically all of the 150-foot photo-receptor sheet is wound on the take-up reel. The closing of contacts 222*a* causes relay RY5 to energize through contacts SOL-3A, 242 and RY8-1. It will be recalled that this relay is normally de-energized and it is through its contacts that power is supplied to the various electrical systems in the machine. But when contacts 222*a* close, provided that contacts RY8-1, 242** and SOL-3A are closed, relay RY5 is energized. This initiates the re-wind operation, and shuts off power to all other machine logic except fuser standby.

The normally-closed contacts RY8-1 and 242 are, of course, almost always closed. The former contacts open only in the case of a paper jam, as will be described below, and the latter contacts open only when the machine is turned off when it is time to replace the photo-receptor sheet. But contacts SOL-3A may well be open when contacts **222*a* close — if the machine is in the middle of a copying cycle. Relay RY5 does not energize until after the copy cycle terminates and solenoid SOL-3 releases. (As described above, if original documents are fed in one after the other, solenoid SOL-3 may not release; the various machine functions are carried out continuously. Similar remarks apply to machine operation in the multi-copy mode. To ensure that the solenoid releases to enable a rewind when the photo-receptor sheet has been used up, contacts 222b are provided in series with switch 20. When the contacts open, the feeding in of an original document cannot result in the operation of relay RY2, timer TM-1 times out, and the solenoid releases. Only if a very long original is fed in will there be a danger of the rewind operation not commencing before the extreme end of sheet 27 is reached. But the machine is not intended for use with originals longer than the largest copy sheet length, and switch 222** operates when enough of the photo-receptor sheet is left to make one more copy.)

As soon as relay RY5 energizes, it latches through its normally-open contacts RY5-1 which are now closed. These contacts are connected in series with contacts 223, and the serially connected contacts are in parallel with contacts SOL-3A and 222a. Thus even though contacts 222a open as soon as the rewind operation begins, relay RY5 remains latched until contacts 223 open. These contacts are controlled by the finger on the photo-receptor module which detects the completion of the re-winding operation, that is, the rewinding of sheet 27 on the supply reel.

With the opening of the normally-closed contacts RY5-2, power to clutch CL-4 is removed, and a torque is no longer applied to the take-up reel to wind up the slack in the photo-receptor sheet. With the opening of the normally-closed contacts RY5-4 power is removed from conductor 235-2 and the various logic circuits.

With the closing of the normally-open contacts RY5-3, lamp 182 is connected through these contacts to power conductor 235-1. Thus the power line is connected across lamp 182 which is now illuminated to inform the user that the system is in the standby mode, that is, the photo-receptor sheet is being re-wound. Lamp 183, which is usually illuminated and provides a ready indication, is turned off at the same time with the opening of the normally-closed contacts RY5-3.

It is clutch CL-5 which, when operated, causes the supply reel to turn in the counter-clockwise direction of FIG. 1 to rewind the photo-receptor sheet. The clutch is powered by rectifier 229, one of whose inputs is connected directly to power conductor 236. The other input is connected through the normally-open contacts RY5-2 to power conductor 235-1. With the closing of these contacts upon the energization of relay RY5, the rewinding operation begins.

Whenever the photo-receptor sheet is rewound, the count representing the number of times that the sheet has been rewound must be incremented. One end of the winding of solenoid SOL-4 is connected through the normally-open contacts RY5-2 to powder conductor 235-1, and the other end of the winding is connected to conductor 236. Consequently, the solenoid is energized each time that relay RY5 is energized. The energization of the solenoid controls movement of pawl 237 which in turn advances 24-tooth ratchet wheel 238. The shaft of ratchet wheel 238 is coupled through 20:1 turn-reducing mechanism 239 to the shaft of cam 240. The overall counting mechanism is arranged so that after 390 incremental steps of cam 240, cam surface 240b controls the closing of contacts 241, and after a total of 400 incremental steps cam surface 240a controls the opening of contacts 242.

As soon as switch 223 opens with the completion of the rewinding of sheet 227 on the supply reel, relay RY5 releases. This automatically restores all systems in the machine for copying functions.

After 390 rewinds of the photo-receptor sheet have taken place, contacts 241 close. Lamp 185 is placed directly across the power conductors and is illuminated to inform the operator that replacement of the photo-receptor module will soon be necessary. At this time, a call may be made to the service company either to send a serviceman to replace the module or to provide a module so that the user can make the replacement after an additional ten rewinds at which time the machine shuts off automatically and can no longer be used until the module is replaced. Although lamp 185 is illuminated, since ready lamp 183 is also illuminated after the rewinding operation, the operator is made aware of the fact that although a replacement of the photo-receptor module will soon be necessary, the machine can still be used. But after 400 rewinds have taken place, contacts 242 open. These are the contacts which supply power to power conductor 235-1 in the first place, and consequently the opening of contacts 242 results in the almost complete shutting off of the machine. No further copying can take place. Only lamp 185 remains illuminated to inform the operator that the reason the machine can no longer be used is that the photo-receptor module must be replaced. When the module is replaced, cam 240 must be turned back to the initial position shown in the drawing.

As described above, switch 222 detects when the photo-receptor sheet has been advanced almost to its end. But switch 224 operates to close its contacts nine copies from the end of the photo-receptor sheet, that is, when the length of the photo-receptor sheet which can still move in the forward direction before the closing of contacts 222a is sufficient to allow nine more copies to be made. If the system is to be operated in the multi-copy mode, and contacts 224 are closed, the rewinding operation commences even before contacts 222a close; this is to prevent the occurrence of a rewind in the middle of the making of multiple copies of an original document. Although in the illustrative embodiment of the invention, the setting of any number of multiple copies, even if it is less than the remaining capacity of the photo-receptor sheet, results in an automatic rewind, it will be obvious to those skilled in the art that the rewind can be controlled to take place only if the remaining capacity is not sufficient for the number of copies required. When the system is operated in the multi-copy mode, the normally open contacts RY1-3 are closed. These contacts, in series with contacts 224, are connected in parallel with contacts 222a. Consequently, just as the closing of contacts 222a initiates a rewind operation, the closing of contacts 224 when the system is operated in the multi-copy mode also initiates a rewind operation.

If the main power switch 179 is in the off position, but contacts 224 are closed to indicate that nine or fewer copies can be made, the system automatically rewinds so that there is no subsequent interruption in use by the next operator. With switch 179 in the off position, power conductor 235 is connected through switch 179, the normally-closed contacts RY1-3, contacts 224 and the winding of relay RY5 to power conductor 236.

Relay RY5 thus operates and latches through contacts 223, and through its normally-open contacts RY5-1 and RY5-4 which are now closed. After the rewinding operation, contacts 223 open and relay RY5 releases. At this time all machine functions turn off except for the stand-by heating in the fuser section which is always present as long as the line cord is plugged into a wall socket.

Figure 3D:
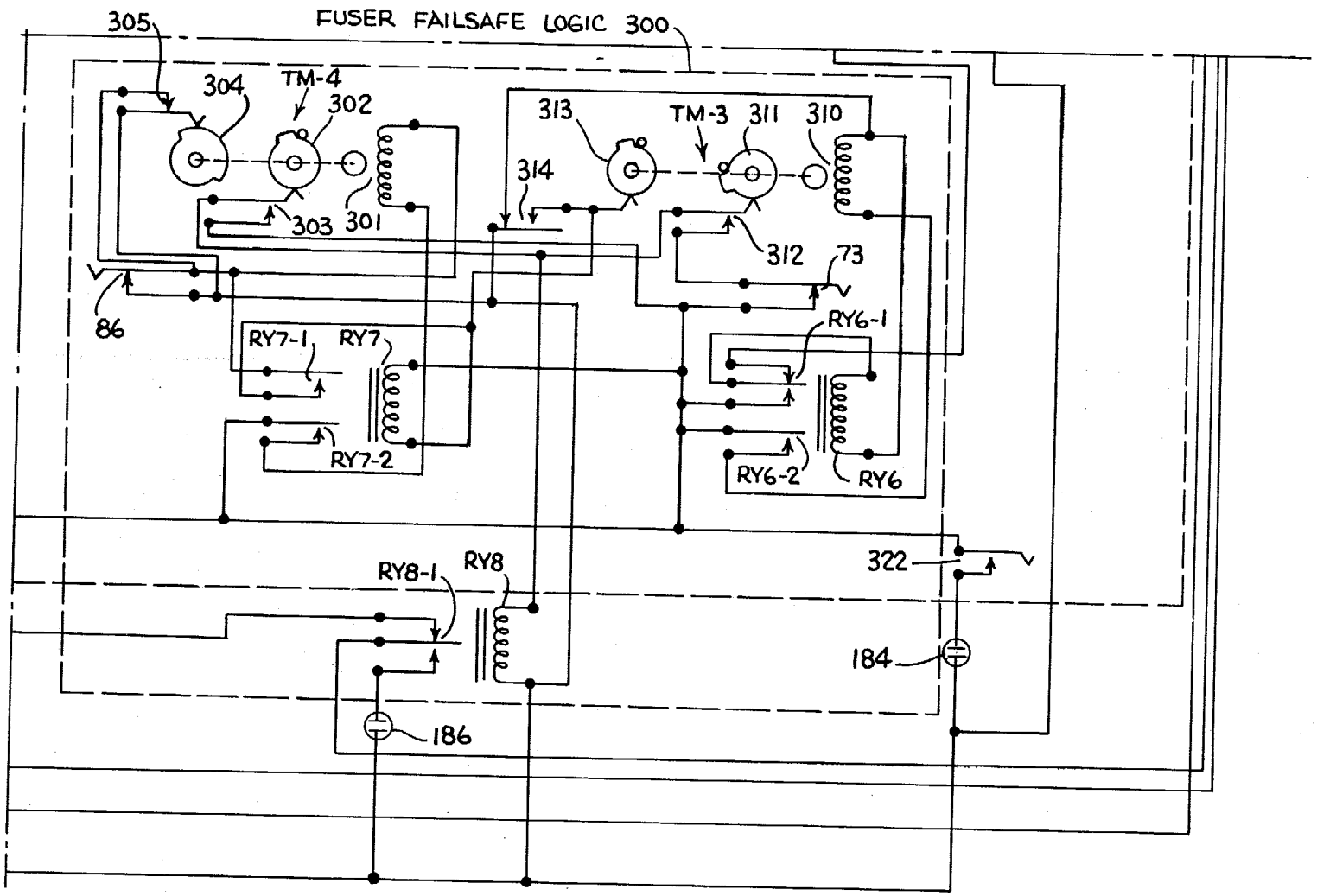

Fuser failsafe logic 300 of FIG. 3D is provided to turn off the machine in the event of a paper jam. Removable panels, not shown, on the machine allow access for clearing the jam, as is known in the art. Contacts 211 of FIG. 3A close at the start of the copy paper feed; in fact, it is the closing of these contacts that controls the energization of clutch CL-1 to begin the copy paper feed. When the contacts close, power conductor 235-2 is extended through switch 20, contacts 222*b*, 211 and normally-closed contacts RY6-1 of FIG. 3D to one end of the winding of relay RY6. The other end of the winding is connected through the normally-closed contacts 314 to power conductor 236. Consequently, relay RY6 energizes. The relay latches through the normally-open contacts RY6-1 which now close and connect the upper end of the winding of relay RY6 to power conductor 235-1. Contacts RY6-1 need not be "make-before-break"; the initial impulse imparted to the transfer contact is sufficient to carry it to the other side.

The upper end of the winding of motor 310 is connected through the normally-closed "make-before-break" contacts 314 to power conductor 236. The lower end of the winding is connected through the now-closed contacts RY6-2 to power conductor 235-1. Consequently, motor 310 starts to operate and turns the connected cams 311 and 313 together in the counter-clockwise direction. These two cams and motor 310 comprise timer TM-3.

Referring to FIG. 1, finger 72 on switch 73 is positioned at the nip of rollers 60, 61. Cam 311 is designed to close the normally-open contacts 312 after the sheet of copy paper has reached switch 73 and has opened it. If that has indeed happened, as it should, relay RY8 does not energize because the path which includes contacts 73 and 312 is open. However, if the copy sheet has not reached switch 73 by the time that it should have indicating that there is a jam, contacts 73 are still closed when cam 311 closes contacts 312. At this time there is a path from power conductor 235-1 through contacts 73 and 312, and the winding of relay RY8 to power conductor 236, and relay RY8 operates. Normally-closed contacts RY8-1 open to remove power from conductor 235-1; for all intents and purposes, this shuts down the machine. At the same time, the normally-open contacts RY8-1 which are now closed control the illumination of lamp 186 to notify the user of a paper jam. Relay RY8 latches mechanically; it must be manually released. After the paper jam is cleared, the relay may be released, following which normal operation may resume.

Assuming, however, that the copy paper reaches switch 73 before contacts 312 close, the opening of contacts 73 prevents the operation of relay RY8 when contacts 312 close. It is now cam 313 which comes into play. As the cam continues to turn in the counter-clockwise direction, contacts 314 transfer when the camming surface reaches the adjacent finger. The upper end of the winding of relay RY7 is connected to power conductor 235-1. The lower end of the winding is connected to the normally-open transfer contacts 314. When "make" contacts 314 are closed by cam 313, the lower end of the winding of relay RY7 is connected through the contacts to power conductor 236. At this time relay RY7 energizes, and latches over contacts RY7-1 and 86 which connect the lower end of the winding of relay RY7 to power conductor 236. The "break" contacts 314 then open, thereby de-energizing motor 310, and cams 311 and 313 are spring-returned to their starting positions in preparation for another cycle while relay RY7 remains latched. Contacts 314 are "make-before-break" to insure that relay RY7 energizes; were the operate path for motor 310 to open before relay RY7 energized, cam 313 might return without closing the normally open contacts 314. But as shown in FIG. 3D, the relay is energized even before the operate path for the motor is even opened.

With the operation of relay RY7, timer TM-4 takes over the timing function from timer TM-3. The upper end of the winding of motor 301 is connected through parallel contacts 86 and 305 to power conductor 236, and the lower end of the winding is connected through now-closed contacts RY7-2 to power conductor 235-1. Cams 302 and 304 thus start to turn when relay RY7 operates. Each of timers TM-3 and TM-4 is arranged to time one-half of the total time required for a copy sheet to travel from the paper tray to the fuser output rollers, with cam 311 timing the distance which is less than half the overall distance from the paper tray to rollers 60 and 61 of FIG. 1. Two timers are provided so that timer TM-3 can begin to time a second copy sheet as a first copy sheet continues to move through the machine while its travel is monitored by timer TM-4.

The lower end of the winding of relay RY8 is connected directly to power conductor 236. The upper end of the winding is connected through normally-open contacts 303 to power conductor 235-1. Consequently, when cam 302 closes contacts 303, relay RY8 operates to shut off the power and to inform the operator that there is a paper jam. It is only if the leading edge of the copy sheet reaches the nip of output rollers 84 and 85 of FIG. 1 before contacts 303 close, thereby opening contacts 86, that motor 301 is turned off, cams 302 and 304 return to their starting positions and relay RY8 is prevented from operating.

Cam 304 controls the opening of contacts 305 before contacts 303 close. It is the opening of contacts 305 which informs the logic that it is time for the copy paper to have reached the output. If contacts 86 are now open, relay RY7 releases and the timer resets.

The reason for providing cam 304, rather than allowing the opening of contacts 86 to reset the timer, is the following. Timer TM-4 starts to operate, i.e., relay RY7 is to energize, when the leading edge of a copy sheet has travelled half-way along its path. Contacts 86 are in the operate path for relay RY7. When a copy sheet reaches the half-way point and timer TM-4 is to take over, it is possible for another copy sheet to be at the output of the machine and for contacts 86 to be open. In such a case, relay RY7 would not energize. To allow the relay to energize, contacts 305 are provided in parallel with contacts 86. These contacts provide an operate path for the relay whether or not contacts 86 are closed. Thus even though one copy sheet may be at the output, a following copy sheet can control the energization of relay RY7 through contacts 305.

But if closed contacts 305 permanently bridged contacts 86, then contacts 86 would serve no function. For this reason, contacts 305 are opened by cam 304 just after the leading edge of a copy sheet should have reached contacts 86. If contacts 86 are still closed, the machine turns off. In effect, contacts 305 ensure that an operate path for relay RY7 is almost always present. It is only shortly after a copy sheet should have reached the output that contacts 305 momentarily do not provide a holding path for relay RY7 and that contacts 86 come into play.

Also included in FIG. 3D is lamp 184 and switch 322. The switch is controlled by the copy paper in the copy paper tray, as will be described below. The switch is also shown in FIG. 1. As long as there is sufficient paper in the tray, the switch is open and lamp 184 remains off. But as soon as there is insufficient paper remaining in the copy paper tray, contacts 322 close and lamp 184 is placed across power conductors 235-1 and 236. At this time the lamp is illuminated to inform the operator that additional copy paper is required.

Whenever clutch CL-1 is energized of FIG. 3A, shaft 67 turns to start the copy paper feed. The shaft makes one turn under control of timer TM-5. The shaft is coupled both to the copy paper feed roller 59 of FIG. 1 and to the 20:1 speed reducing mechanism 294. For every 20 feeds of copy paper, cam 295 turns once and closes contacts 296. This results in the energization of solenoid 397 which, as will be described below, adds a metered amount of toner to the developer system to replace the toner used up during the making of the preceding 20 copies. In the event the copies being made are too light and an extra shot of toner is required, the operator may press button 297 on the control panel; when contacts 297*a* close, solenoid 397 is energized and toner is metered into the developer system.

Referring to the left side of FIG. 3C, it will be noted that there are six conductors which connect switches 222, 223 and 224 to the rest of the circuit. These switches are contained in the photo-receptor module 156 of FIG. 1, and consequently the switches require six connections between the module and the rest of the logic which is contained in the base section. Clutches CL-4 and CL-5 are also contained in the photo-receptor module, and require another three connections to the base section. Four connections are not required since one end of each clutch is connected to common conductor 236. In all, nine connections are required between the photo-receptor module and the base section. The nine conductors which effect these connections may be terminated in mating 9-pin and 9-socket connectors not shown. When the module is removed from the base section, the connectors are separated, and prior to the insertion of the module in the base section a connection between them is established.

It will be recalled that one of coronas 30 of FIGS. 1 and 3B is also in the photo-receptor module. The shell of the corona is connected to earth ground, the module frame, but the other corona terminal is connected to a 6-kilovolt positive supply 291 in the base section. A separate single-pin, high-voltage connector not shown is used to effect this connection.

DESCRIPTION OF PHOTO-RECEPTOR MODULE AND THE CONTROL OF ITS OPERATION -- FIGS. 5-8B

FIGS. 5, 6 and 7 depict photo-receptor module 156. The path of sheet 27 is seen most clearly in FIG. 6. As sheet 27 leaves the supply roll 25, it first passes between roller 28 and grounded roller 29, the former terminating in brake 749 of FIGS. 5 and 7 so that a slight drag is applied to the sheet only when it moves in the forward direction. The sheet then passes between the two coronas 30 and over grounded plate 31. The corona shield included in the module is secured to it, earth ground, by a pair of tabs at each end as shown in FIGS. 5 and 7. It is while the sheet passes over plate 31 that it is exposed. As the sheet continues to move over grounded roller 32, the developer section applies toner to the charged areas.

It is as the sheet passes over grounded roller 33, with the leading edge of copy sheet 57 being in synchronization with the leading edge of the exposed section of the photo-receptor sheet, that corona 34 controls the transfer of toner from sheet 27 to the copy paper. Sheet 27 then continues to pass by erase corona 35 as it bears against grounded plate 36; the cleaning brush not shown in FIG. 6 then brushes off any toner which remains on sheet 27. Finally, the sheet moves between pressure roller 42 and drive roller 41 on its way to take-up roll 26. All of the module rollers are metallic, except for rollers 28, 41 and 42 which are rubber-coated.

In any copying machine, it is desirable for the exposure lamps and the photo-receptor material to be "matched" to each other in the sense that the photo-receptor material has a maximum response to the frequency of the radiation of the particular lamp employed. It is well known in the art which lamps work best with which photo-receptor materials, and how to formulate such materials for maximum response to a particular wavelength. In the illustrative embodiment of the invention, the exposure lamps 18 emit a blue-green fluorescent light and are of General Electric type No. FA-18T8/MGB/5390. The substrate, which is a base for the photoconductive coating, is a commercially available conductive paper base material such as "Electrofax Plate Stock" having a conductivity range characteristic of this type of medium under normal ambient RH and temperature conditions. The electrophotographic coating can consist of:

| Part by Weight | Material |
|---|---|
| 125.00 | Zinc-oxide powder, type 345-PC, manufactured by St. Joe Minerals Corp. |
| 50.00 | Resin type E-028, manufactured by Desota Chemical Coatings, Inc. |
| 77.50 | Toluene solvent |
| .095 | Erythrosin "B" dye, manufactured by Allied Chemical Corp. |
| 2.50 | Methanol solvent |

As is known in the art, the zinc-oxide powder is dispersed in the E-028 resin, the toluene solvent being required during the manufacturing process for mixing the two components. The methanol solvent is required to dissolve the dye, the dye being the element which controls the photo-receptor to respond to the particular wavelength emitted by the lamps. After the mixture is coated on the paper base material, the solvents evaporate as is known in the art. Preferably, the weight of the photo-receptor coating is in the range 26–28 pounds/3,000 square feet. Such a coating, as it moves past the 6-kilovolt charging coronas 30 at a speed of 3.5 inches/second, exhibits a charge acceptance of 500 volts in the absence of any light; following exposure of an unfatigued sheet under normal operating conditions, the residual charge is 40 volts. The residual charge is insufficient for attracting toner as the sheet passes the developer system. Although the residual charge increases as the sheet is continuously charged and exposed, i.e., as it exhibits optical fatigue, if necessary, as described above, an increasing negative potential may be applied to the magnetic brush to compensate for this effect.

The path through which the photo-receptor sheet moves is of considerable importance. Were the two rolls separated relatively far from each other, with the sheet moving in an essentially horizontal direction past horizontally-disposed copying step positions in the base section, it would not be possible to make module 156 compact in size. In an actual machine constructed in accordance with the invention, the distance between the axes of the supply and take-up reels is only 4.25 inches. With a 150-foot photoreceptor sheet wound on the two reels with the roll diameters varying between 3.5 and 1.0 inches as the sheet is transferred back and forth where sheet 27 moves in a straight line from one roll to the other, the path length would be far too short to carry out all of the copying steps in the process. It is for this reason that the path length between the two rolls has been deliverately shaped to accommodate all of the required copyiny steps, without however unduly increasing the size of the photo-receptor module.

Various tangent lines may be drawn between the supply and take-up rolls, the length of the tangent lines necessarily varying as sheet 27 is transferred from one roll to the other. If sheet 27 were to move along a substantially straight path between the two rolls, it would move along one of these tangent lines, and all of the copying step functions would have to be performed along a path equal to the shortest tangent line. An inspection of FIG. 6 makes it clear that the actual path along which the copying step functions are performed according to the invention is considerably longer than the shortest tangent line between the two rolls. The actual path extends from the top of coronas 30 in FIG. 6, down past roller 33, and then up past grounded plate 36 where the final cleaning of the sheet takes place. This path, according to the invention, is at least three times longer than the length of the minimum tangent line which can be drawn between the supply and take-up rolls. The path is approximately five times as long in the illustrated machine; the minimum tangent line is about 2 inches and the path past the copying step stations is about ten inches. The relatively long path is achieved by having sheet 27 move down in an essentially vertical direction on the side of the supply roll furthest away from the take-up roll, and to then have the sheet move in an upward direction under the supply roll toward the take-up roll. This not only provides a relatively long path within the relatively small module, but the sharp angle through which the sheet moves over roller 33 is advantageous in and of itself. When the sheet moves through an angle exceeding 45° at the toner-transferring station, there is little difficulty in ensuring that the copy sheet separate from the photo-receptor sheet after the toner-transfer step.

Another way of describing the overall path through which the sheet moves is to consider the actual angular changes in the path. The sheet first moves in a substantially downward direction past the charging, exposing and toner-applying stations. If the path is plotted on X-Y coordinates, this corresponds to an angle of 270°. The sheet then moves through an angle of approximately 135°, an angle of approximately 45° in the second quadrant, past the erase and cleaning stations. Consequently, the total change in angle is approximately 135° as the sheet moves past the various copying-step positions. In accordance with the principles of our invention a compact module can be achieved if the photo-receptor sheet changes its direction in excess of 110 degrees as it moves between the two reels past the various copying-step positions.

Still another way of describing how the compact size of module 156 is achieved is to consider the average angle which the sheet makes with a line drawn between the reel axes as the sheet moves past the various copying-step positions. It is not feasible to provide an essentially straight horizontal path of movement for sheet 27 if all of the copying-step functions are to be performed along a short path. It is for this reason that the functions are performed along a path which is for the most part at a large angle to the line between the reel axes. The average angle which the sheet makes with the line drawn between the reel axes, along the path of the sheet past the copying-step positions, is a good measure of the compactness of the module because as the average angle increases it is apparent that more and more of the path is away from the line between the axes; the only way that all of the copying-step functions can be "squeezed-in" if the two reels are close to each other is for a substantial part of the path to be away from the line between the axes.

Referring to FIG. 6, the average angle is easily computed since almost all of the path length is comprised of straight-line segments, and it is certainly not difficult in the illustrative embodiment of the invention, or in any other, to compute the average angle which even a curved path segment makes with a straight line. In accordance with the principles of our invention, a compact module is achieved when the average angle is in excess of 45°. In the illustrative embodiment of the invention the average angle is in excess of 55 degrees.

FIG. 6 depicts still another feature of considerable importance. Referring to FIG. 2, it will be noted that chain 139 passes over sprockets 132 and 135, the two sprockets being of the same size. The axis of sprocket 132 is the axis of photo-receptor sheet drive roller 41 of FIG. 6, while the axis of sprocket 135 is the axis of the supply reel. Consequently, the forward drive roller 41 and the supply reel move at the same angular speed as sheet 27 moves in the two respective directions. However, the speed of the sheet in the forward direction is a function of the diameter of roller 41, while the speed of the sheet in the reverse direction is a function of the diameter of the supply roll wherein the speed thus increasing substantially during rewind as the supply roll continuously increases in size. It is especially during the high-speed rewind operation that it is important to prevent skewing of sheet 27. If the sheet moves sideways during its travel, the edges can become frayed and the life of the sheet may be shortened.

It is to prevent the skewing of the sheet that edge guides are provided throughout the path of travel of the sheet. The edge guides are of two basic types. First, as sheet 27 moves over various rollers or the supply and take-up reels, sideways movement of the sheet is prevented by flanges at the ends of the rollers and the reels. Referring to FIG. 6, the edges of sheet 27 are guided not only as they pass the flanges on the supply and take-up reels, but they are also guided by flanges on rollers 29, 32 and 33. In FIG. 6, sheet 27 is shown in both heavy and light lines. The heavy lines represent all path segments where edge guidance is provided.

The other form of edge guidance ——along path segments where there are no rollers ——consists of brackets having an L-shaped cross section secured to the side plates of the module 156. A typical bracket of this type is shown by the numeral 323 in FIGS. 6 and 7. As seen most clearly in FIG. 6, the L-shaped cross section provides both a shelf over which the back of the sheet passes, and a side guide which bears against the edge of the sheet. Referring to FIG. 6, edge guides comparable to guides 323 are also provided on the sides of plate 36, although not shown in FIG. 6. The nominal width of sheet 27 in the illustrative embodiment of the invention is twelve inches. Oppositely disposed edge guides including both the roller and reel flanges, and brackets 323 are carefully placed at a spacing varying between 12 inches and no more than 12-1/32 inches, and the guides are polished for minimum abrasion of the sheet edges. Of course, the various rollers should exhibit as little end-to-end taper as is possible in order to minimize any tendency for the sheet to skew.

Referring to FIG. 6, and noting the total length of the dark lines relative to the total length of the light lines in the path of sheet 27, it will be appreciated that edge guidance is provided along a relatively large portion of the overall path of sheet 27. The exact amount of edge guidance necessarily varies with the size of the supply and take-up rolls since the length of the path along the flanges of the two reels varies as the sheet is wound and unwound on each reel. Nevertheless, no matter how much of the sheet is wound on either reel, in accordance with the principles of our invention edge guidance is provided along at least 70 percent of the overall length of the path of travel of the photo-receptor sheet between the supply and take-up reels.

FIG. 5 depicts the three switches 222, which include two contact pairs as shown in FIG. 3C, 223 and 224. All of the various switches are controlled by finger **140*a* in FIG. 7 bearing against the take-up roll. This finger extends from block 140*b* which is mounted on shaft 140*c*. The shaft terminates in a block 144 in FIG. 5 from which finger 144*a* extends. It will be recalled with reference to FIG. 3C that switch 224 operates when enough of sheet 27 remains on the supply reel to allow only nine more copies to be made, switch 222 operates when no further copying should take place prior to a rewind, and switch 223 operates at the end of the rewind operation after the sheet is completely rewound on the supply reel. Although finger 140*a* could bear against the supply roll, if it did it might damage the photo-receptor surface; it is better to have the finger engage the back side of sheet 27** on the take-up roll.

Referring to FIG. 5, as the supply roll is used up and the axis of the supply roll being coincident with the axis of bushing 194 and clutch CL-5 which are not shown, finger **144*a* rotates in the clockwise direction. The first switch which is operated is switch 224, to indicate that after another nine of the largest-size copies are made, the sheet must be rewound. As described above, it is after switch 224 operates that a rewind is automatically initiated if the system is operated in the multi-copy mode or if the main power switch 179 is turned off. After sheet 27 has been completely used up and finger 144*a* has rotated a bit further in the clockwise direction, switch 222 operates to control a rewind. As sheet 27 is rewound on the supply reel, finger 144*a* rotates in the counter-clockwise direction. After the sheet has been completely rewound and finger 144*a* bears against switch 223**, this switch operates to stop the rewind and to place the machine in a condition in which additional copies may be made.

Figure 8A:
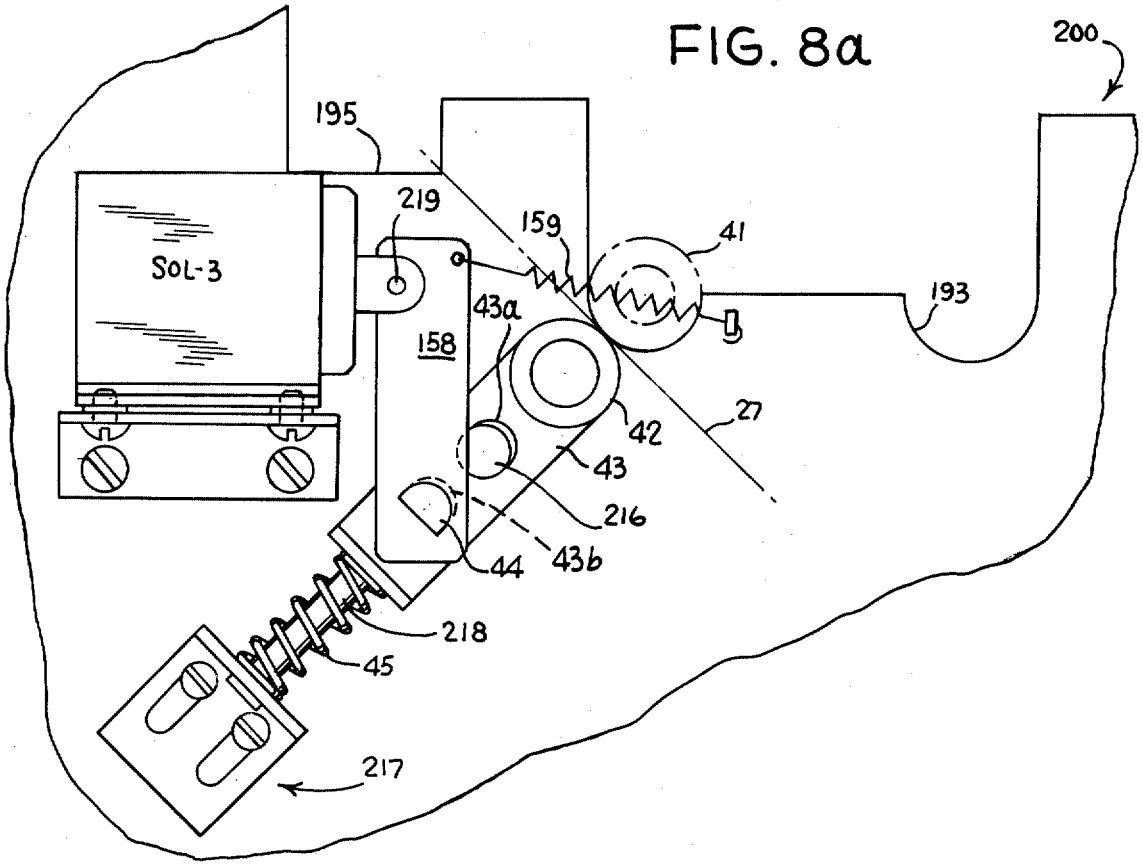
FIGS. 8A and 8B illustrate the elements in the base section of the machine for controlling movement of the photo-receptor sheet, FIG. 8A showing the positions of the various elements when the sheet is moved and FIG. 8B showing the positions when the sheet is stationary.
Figure 8B:
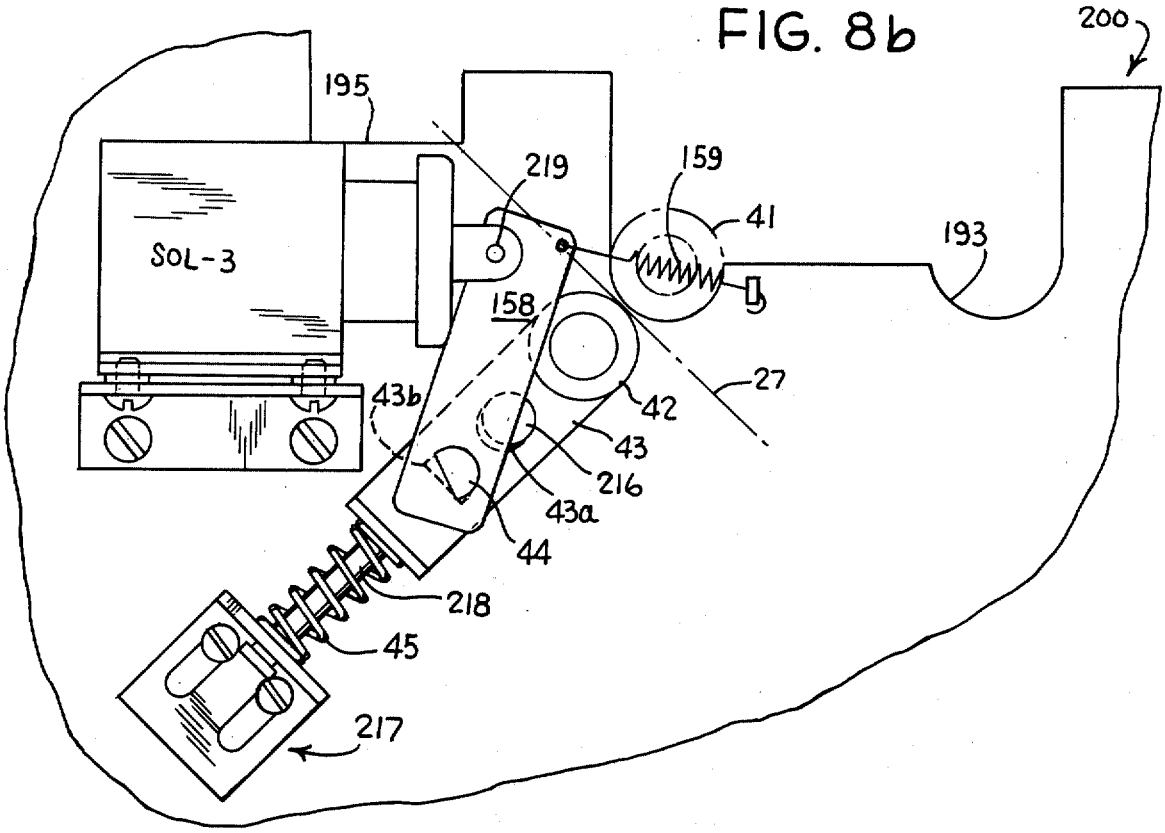

FIGS. 8A and 8B illustrate how the drive of sheet 27 in module 156 is controlled. Referring to FIGS. 1 and 6, it will be recalled that drive roller 41 in the module turns continuously against the backside of sheet 27, but the sheet moves only when pressure roller 42 is moved up against the zinc oxide coated surface of sheet 27. Each of FIGS. 8A and 8B illustrates the elements in the base section which control movement of roller 42 toward and away from sheet 27. Roller 41 is shown in each of FIGS. 8A and 8B in phantom lines only, inasmuch as this roller does not constitute part of the base section and it is only the base section which is illustrated in the two figures.

Referring to FIG. 8B, slide 43 is secured to shaft 218 which can move slightly in the axial direction through a hole provided for that purpose in bracket 217 attached to a side of the base section. All of the parts illustrated in FIGS. 8A and 8B are duplicated on both sides of the base section, except for solenoid SOL-3 and lever 158 which are mounted on only one side. Spring 45 biases the slide 43 away from bracket 217 for forcing pressure roller 42 into engagement with drive roller 41. An elliptical shaped cut-out **43*a* is provided in the slide and a stationary stud 216 passes through this cut-out. The stud and cut-out constrain movement of slide 43 to be in line with the axis of shaft 218 while permitting a slight movement of the slide between the sheet-moving position of FIG. 8A and the sheet-stationary position of FIG. 8B**.

Slide 43 includes a second cut-out **43*b*, this cut-out having a flat section and a curved section. One end of cam rod 44 is placed within the cut-out, the cam being extended through and being secured to lever 158. The other end of the lever is connected to the plunger of solenoid SOL-3 and to spring 159. Cam rod 44 extends from one side of the machine to the other for coupling both slides 43 to each other, so that solenoid SOL-3** can control movement of both.

With the solenoid de-energized, spring 159 pulls lever 158 in the clockwise direction as shown in FIG. 8B. With cam 44 rotated slightly as shown, one of its corners forces the flat section of cut-out **43*b* downward toward bracket 217. Thus slide 43 moves toward the bracket, withdrawing pressure roller 42 from drive roller 41. Spring 159 is stronger than spring 45 so that when the solenoid is de-energized, lever 158 assumes the position shown in FIG. 8B and photo-receptor sheet 27** is not advanced.

But when the solenoid is operated as shown in FIG. 8A, lever 158 is pulled in the counter-clockwise direction against the force of spring 159. Cam 44 thus assumes the position shown in which slide 43 can be pushed upwardly by spring 45 until the flat section of cut-out **43*b* bears against the flat edge of cam 44. In such a case, pressure roller 42 bears against drive roller 41 with the photo-receptor sheet between them, and the sheet is advanced. Bracket 217** is provided with adjusting screws for precisely positioning it so that when the solenoid is energized the rollers are engaged, and when the solenoid is de-energized the rollers are disengaged.

DESCRIPTION OF DEVELOPER SYSTEM — FIGS. 9 THROUGH 16

The developer system for any copying machine must not only apply toner to the exposed photo-receptor, but must also replenish the toner as it is used up in the making of copies. In conventional copying machines, a toner supply is generally provided with a small amount of toner being metered into that part of the developer system which applies toner to the photo-receptor as the toner is used up. Referring to FIG. 1, it will be noted that developer system 320 is embedded in the machine underneath light path 22. Consequently, it is not feasible to place a toner supply directly above the developer system. For this reason, a special developer system is incorporated in the machine.

A perspective view of the developer system is shown in FIG. 9. The entire system is mounted on a base plate 407 which includes a guide ridge 409 on its bottom surface. The entire developer system slides in and out of the machine over a supporting plate 408 of FIG. 11 in the base section which includes a notch for guiding ridge 409. Mounted on the base plate 407 are a toner supply 361 and a housing 360, magnetic brush 363 being rotated within housing 360.

Figure 11:
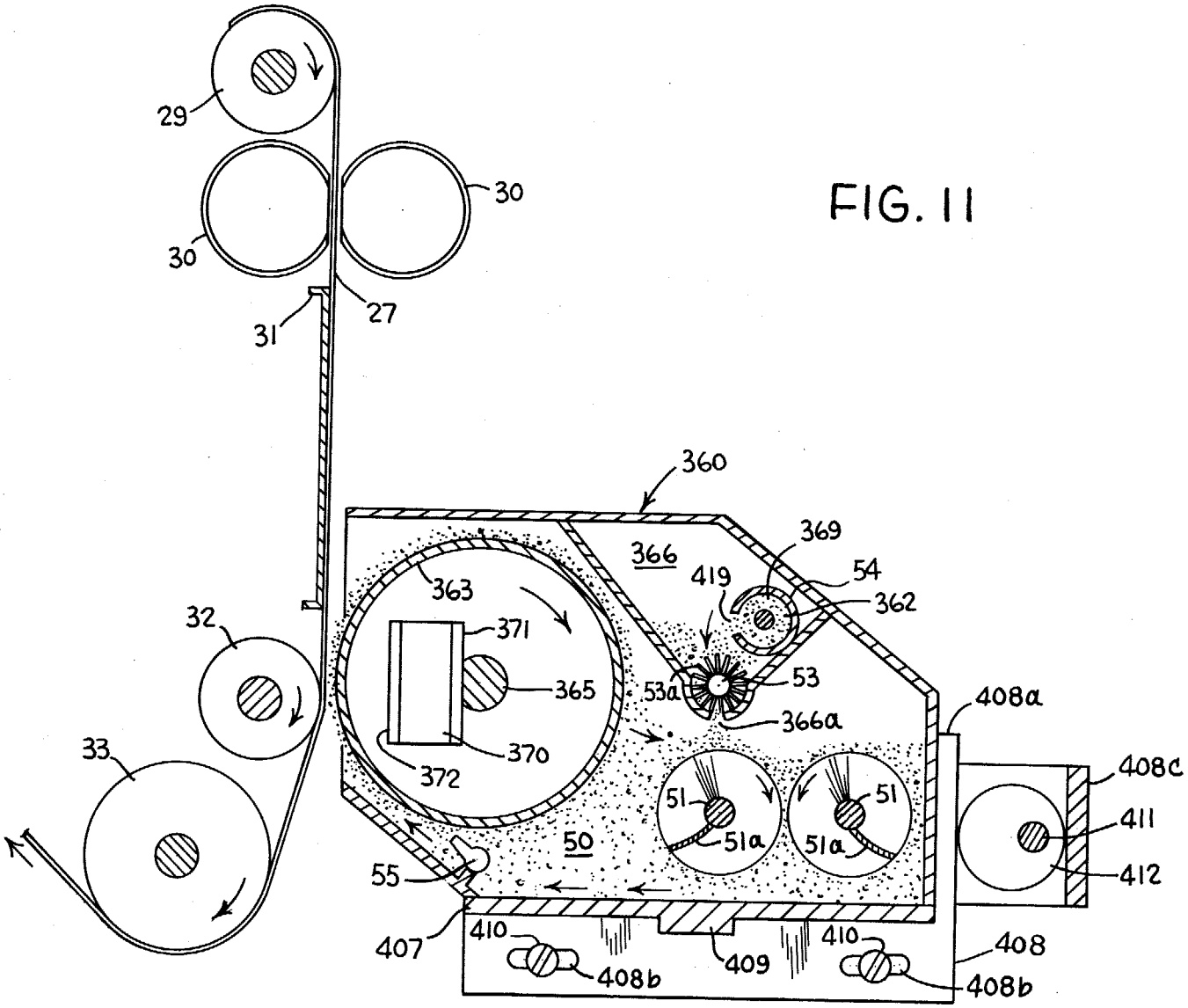
FIG. 11 is a view through housing 360 looking at a side of the developer system and shows the developer system as it functions adjacent to the moving photo-receptor sheet.

The functional operation of the developer system can be best understood with reference to FIG. 11, this figure being a sectional view through housing 360. Within the housing there is a reservoir of toner 366; this reservoir is filled by transferring toner 362 from supply 361 of FIG. 9 in a manner which will be described below. Periodically, shaft 53 is rotated 22.5° and teeth 53*a* move incrementally. All along the bottom of reservoir 366 there is a slit 366*a*, and teeth 53*a* extend all along shaft 53 from one end of housing 360 to the other. With each incremental movement of shaft 53, the toner held between two adjacent teeth 53*a* falls out of slit 366*a* into the bottom region 50 of the developer system.

A pair of shafts 51 turn continuously in the developer system in the directions shown in FIG. 11. Around each of these shafts there is a mixing screw 51*a* as seen most clearly in FIG. 13. In actual practice, instead of only one screw on each shaft, four interleaved screws may be provided to enhance the mixing. The toner mix in the developer system consists of toner particles and magnetic carrier particles, as is known in the art. The mixing screws simply serve to assure that any new toner which is added is mixed thoroughly with the carrier particles. Because the two shafts 51 turn in opposite directions, one of screws 51*a* moves the mix toward the rear of the machine and the other moves the mix toward the front of the machine. The result of this churning action is the complete mix of the toner particles and the magnetic carrier particles.

Metallic cylinder 363 rotates in the direction shown in FIG. 11. Within the cylinder, stationary magnets 370, poled in the horizontal direction, produce a magnetic field which is strongest in that part of cylinder 363 which at any time is adjacent to photo-receptor sheet 27. The toner mix is picked up at the bottom of cylinder 363 and rotates with it in the clockwise direction of FIG. 11. As is known in the art, the outer surface of cylinder 353 is knurled to provide a large surface area for picking up the toner mix. Typically, the thickness of the toner mix when picked up is approximately 1/16. A doctor blade 55 is provided to reduce the thickness of the mix on the cylinder, as is known in the art. As the mix rotates on cylinder 363 and moves into the region of the strong magnetic field, the magnetic particles line up with the field and extend directly out from the cylinder approximately perpendicular to sheet 27. It is the magnetic field which in effect forms a brush of magnetic material saturated with toner particles. As the brush rubs against sheet 27, the toner particles are transferred to the charged areas on the sheet. As the cylinder continues to rotate in the clockwise direction, the magnetic field weakens and by the time the magnetic particles on the cylinder pass the uppermost position they fall off back into the toner mix.

It is important when tuning the machine to properly position the cylinder 363 relative to the sheet 27. Toward this end, a mechanism is provided to move the entire developer system a fraction of an inch in the horizontal direction. Referring to FIG. 11, support plate 408 which is included in the base section of the machine and carries the entire developer system is capable of moving slightly in the horizontal direction. Support plate 408 has cut-outs 408*b* on its sides, through which pins 410 pass, the pins being secured to the base section frame. By loosening the pins, the plate 408 can be moved in the left-to-right direction in FIG. 11. Support plate 408 includes two upstanding walls 408*a* and 408*c*. Eccentric cam 412 is mounted on shaft 411 between the two walls, the shaft being fixed in position. When the cam is turned slightly, plate 408 is forced to move in the horizontal direction. By adjusting the position of the cam, the optimum position of the magnetic brush relative to sheet 27 can be achieved.

Figure 12:
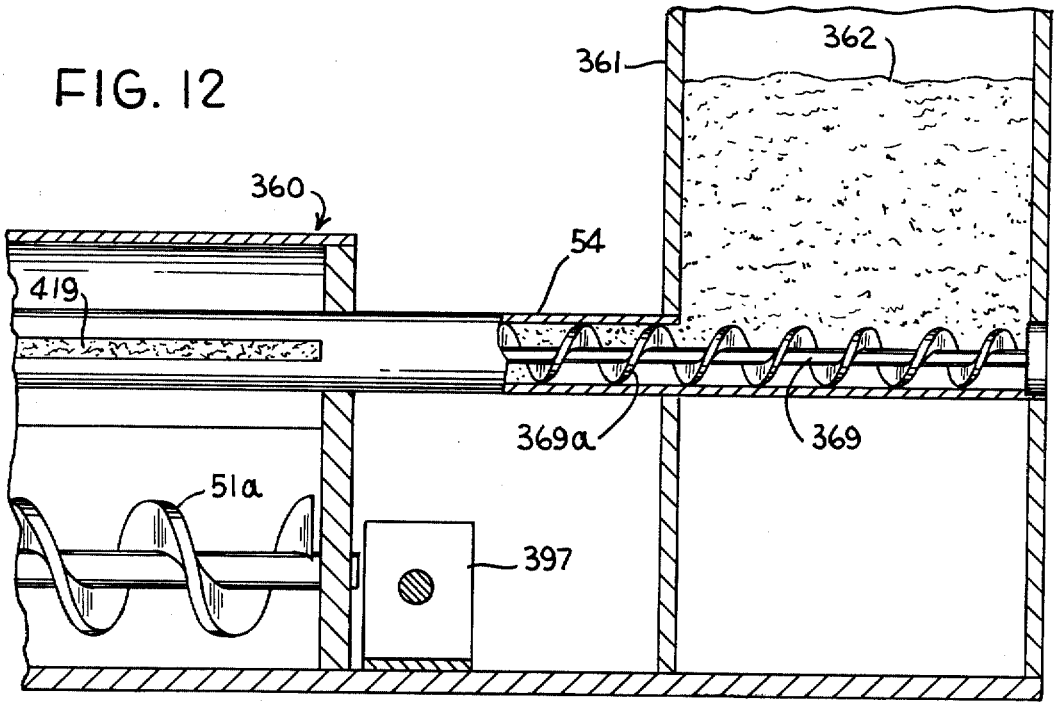
FIG. 12 is a sectional view through the developer system along tube 54.

FIGS. 9, 11 and 12 best illustrate the manner in which toner is conveyed from supply 361 to reservoir 366. The supply is filled simply by pulling out the entire developer section from the machine. A tube 54 couples supply 361 to reservoir 366. The upper half of the tube in supply 361 is cut away. Shaft 369, with conveyor screw 369*a* around it, extends all the way through supply 361, tube 54 and reservoir 366. Since the toner 362 in supply 361 is in open communication with conveyer screw 369*a*, when shaft 369 turns toner is conveyed through tube 54 toward reservoir 366. Tube 54 has a slit 419 in the reservoir, and consequently toner conveyed through tube 54 exits the slit into the reservoir. The fit between screw 369*a* and the inside diameter of tube 54 provides for a clearance of approximately 0.02 around the screw. This clearance is necessary because if the reservoir is filled, the conveyer screw should not tend to force toner into the reservoir. The conveyer screw simply keeps the reservoir filled without packing toner in it.

The toner metering system is depicted in FIGS. 9–11. Solenoid 397 is mounted on the base plate 407. Outward movement of plunger 398 is blocked by stop 399*a* when the solenoid is de-energized. The tip of the plunger is pivoted to lever 401, the lever being maintained in the position shown when the solenoid is de-energized by spring 400 which is connected between the lever and bracket 399*b*. When the solenoid is energized, plunger 398 is pulled to the right and lever 401 rotates 45° in the counter-clockwise direction. Clutch 402 couples lever 401 to shaft 53, the clutch serving to couple the two elements only when the lever is turned in the counter-clockwise direction. Thus when the solenoid is energized, shaft 53 turns in the counter-clockwise direction of FIG. 10 and teeth 53*a* of FIG. 11 advance one position to meter out toner from reservoir 366 to the bottom of the developer system. When the solenoid releases and lever 401 returns to the position shown in FIG. 10, shaft 53 does not turn by virtue of the operation of clutch 402. As shown in FIG. 10, the two leads to solenoid 397 can be coupled to the logic circuit in the base section by a connector 359 to allow the developer system to be completely removed from the base section when desired.

The magnetic brush itself consists of a conducting cylinder 363 and a stationary permanent magnet inside the cylinder, as seen most clearly in the cross-section view of FIG. 11. The permanent magnet consists of elements 370, 371 and 372 which together produce a magnetic field approximately in the left-to-right direction of FIG. 11 all along the length of the cylinder. The permanent magnet is mounted on shaft 365, the shaft having a slot 365*a* in one end thereof extending out of the housing 360, as seen most clearly in FIG. 14. The same end of the shaft is secured in a two-fingered clamp 368 having a screw 368*a* for tightening the two fingers against each other. The angular position of shaft 365 can be adjusted by first loosening the screw and then using a screwdriver to turn the shaft, after which the clamp is tightened to maintain the shaft in the selected angular position. The position of the shaft is adjusted to provide the best possible copy quality, the magnetic field being oriented in an approximately left/right direction in FIG. 11.

Figure 14:
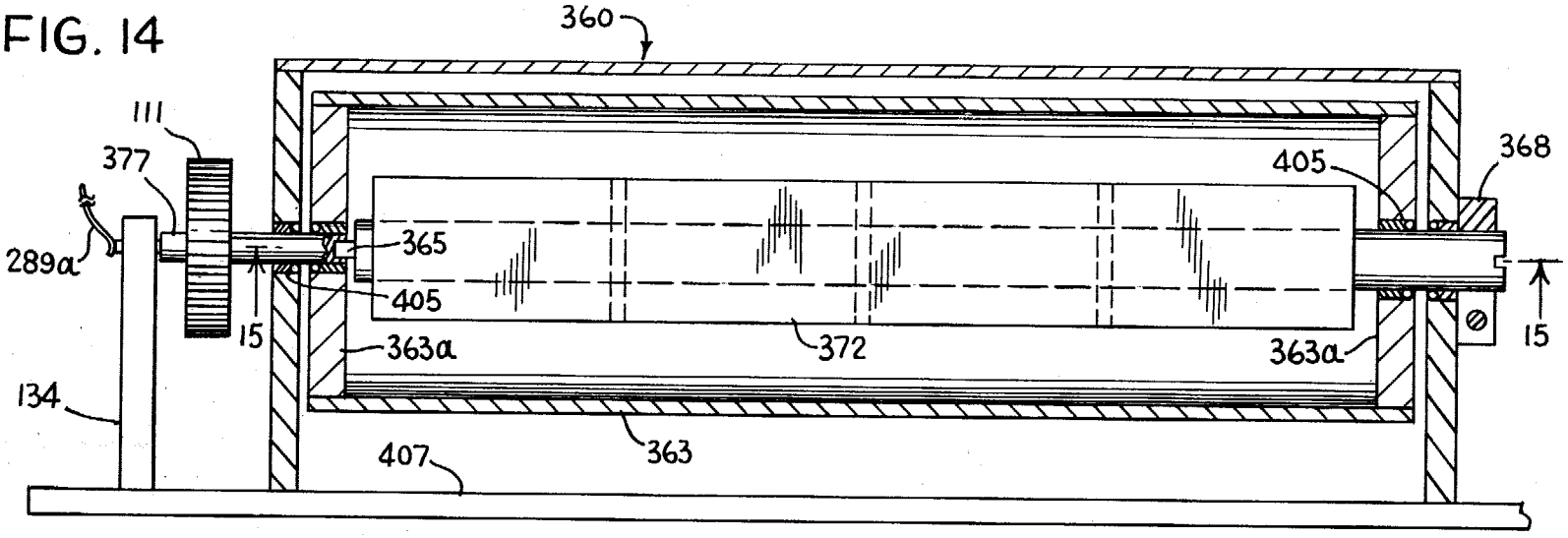
FIG. 14 is a sectional view illustrating the construction of the magnetic brush of the developer system.
Figure 15:
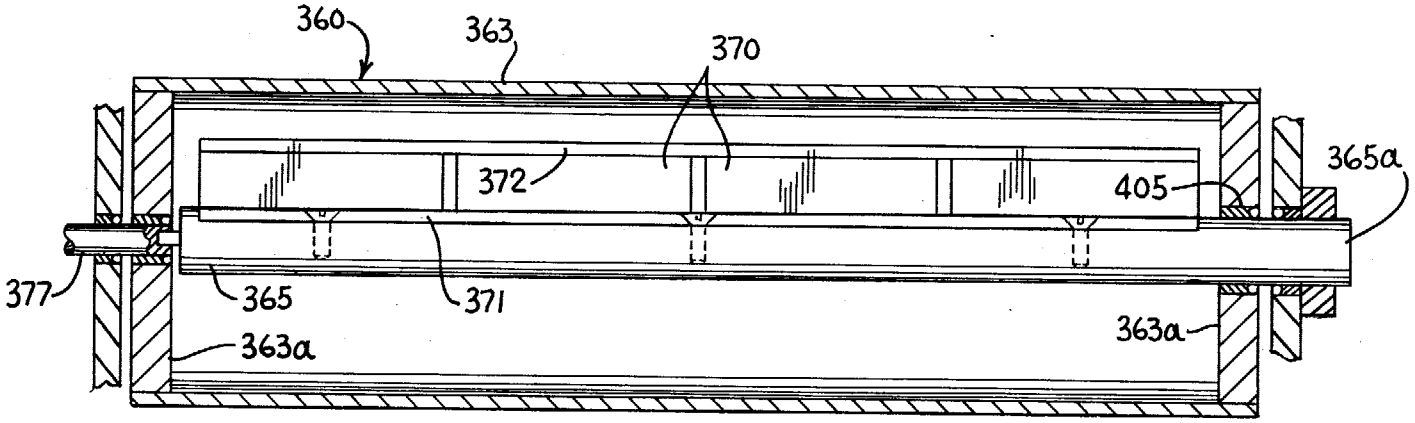
FIG. 15 is a sectional view taken along the line 15—15 of FIG. 14.

FIGS. 11, 14 and 15 depict the mounting of the magnet on shaft 365. The magnetic field must be uniform all along the length of the cylinder or else different areas of the finished copies will exhibit different ink densities. A single magnet, approximately one inch in width and ⅜ thick could be mounted on the flat surface of shaft 365. However, the magnet would have to be greater than twelve inches in length and such magnets are difficult to secure commercially. We have discovered that shorter magnet lengths may be utilized instead — without degrading the copy quality. As shown in FIGS. 11, 14 and 15, four magnet segments 370 are utilized. An iron plate 371 is secured to the flat face of shaft 365. The four magnet segments are mounted on this plate and then another iron plate 372 is placed over the magnets. Even if there are small gaps between the magnets, as shown exaggerated in FIGS. 14 and 15, the two plates 371 and 372 eliminate the spurious fields at the junctions of the magnets, and there results a field of uniform density across the entire length of the cylinder.

Although the cylinder rotates, shaft 365 and the magnets mounted thereon remain stationary. FIGS. 14 and 15 illustrate how the shaft is maintained stationary while at the same time the cylinder is allowed to rotate. The right end of shaft 365 extends through a bearing 405 in the end wall 363*a* of conducting cylinder 363, and also extends through a hole in the side of housing 360. The bearing 405 is preferably provided with a seal to prevent toner and carrier particles from getting into the cylinder. A similar seal is provided on the side of housing 360 to prevent toner and carrier particles within the developer system from inadvertently flowing along the shaft 365 out of the developer system.

At the left end of the system, shaft 365 has a reduced diameter. The left end wall 363*a* of the cylinder is fixed to conducting shaft 377. This shaft extends through a bearing and seal 405 in the left side of housing 360 and terminates in gear 111. When the gear is driven, as will be described below, shaft 377 and cylinder 363 rotate. Shaft 377 has an axial groove through which the reduced diameter shaft 365 passes, shaft 365 being fixed in bracket 134 which is mounted on base 407. Shaft 377 simply turns around shaft 365 which remains stationary.

As described above with reference to FIG. 3B, a high DC potential is developed on conductor 289 for biasing cylinder 363. The potential is applied by a leaf spring 289*a*, secured in the base section to contact the end of shaft 365 when the developer system is inserted in the machine, as seen most clearly on FIG. 14. Shaft 377 and cylinder 363 are necessarily made of conducting material so that the potential on leaf spring 289*a* can be extended to the cylinder. But is is important to insulate the rest of the machine from this high potential. Toward this end, gear 111 is made of plastic material. Although the gear is mounted on shaft 377, because the gear is made of insulating material the high potential on the shaft is not extended to the drive system in the base section. Similarly, bracket 134 and housing 360 are made of plastic material so that the high potential does not appear on base plate 407. Finally, the right end of shaft 365 is also made of insulating material so that the high potential does not appear at screw slot 365*a*.

Figure 16:
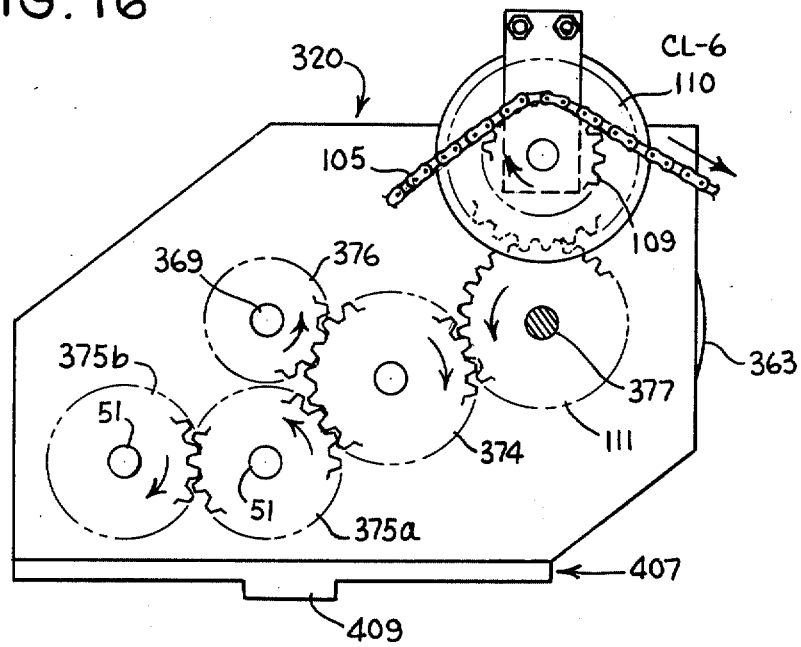
FIG. 16 is a side view of the developer system showing the manner in which the various elements therein are driven.

The drive for the developer system is shown in FIG. 16. It will be recalled with reference to FIG. 2 that drive chain 105 turns gear 109 which is secured to gear 110, the latter gear meshing with gear 111 in the developer system. Clutch CL-6 couples the shafts of gears 109 and 110 so that gear 110 turns only when the clutch is energized. The clutch, and gears 109 and 110, are mounted on a bracket in the base section as depicted in FIG. 16. As the developer system of housing 360 mounted on plate 407 is moved out of the base section of the machine through a removable side panel, not shown, gear 111 simply disengages from gear 110. After toner supply 361 is replenished, the developer system is pushed back into the machine with the two gears once again meshing. Although cam 412 on FIG. 11 controls the positioning of the entire developer system by moving it slightly in the horizontal direction, this slight movement of ± 1/16 is not enough to interfere with the proper meshing of gears 110 and 111.

Figure 13:
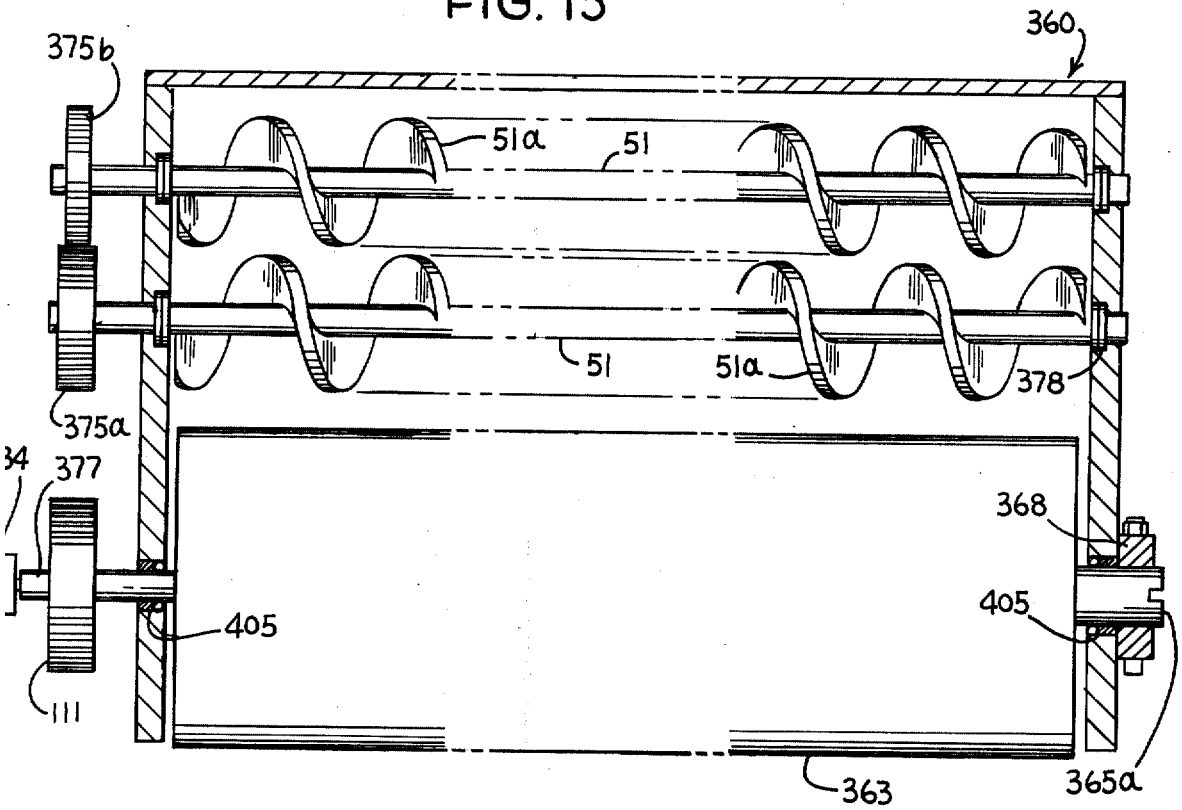
FIG. 13 is a sectional view through the bottom of the developer system.

Gear 111 is mounted on shaft 377, as seen most clearly in FIGS. 13 and 14. Idler gear 374 of FIG. 16 is provided simply to transmit motion to gears 375*a* and 376. The latter gear is mounted on toner conveyor screw 369 of FIG. 12, and gear 375*a* is mounted on one of the toner mixing shafts 51 of FIG. 13. Gear 375*b*, which is mounted on the other toner mixing shaft 51, is driven by gear 375*a*, as shown on FIG. 16. It is thus apparent that shafts 51, 369 and 377 turn only when clutch CL-6 is energized. The developer system functions only when a copy is being made and clutch CL-6 is energized by the system logic.

DESCRIPTION OF CLEANING SYSTEM — FIG. 17

Figure 17:
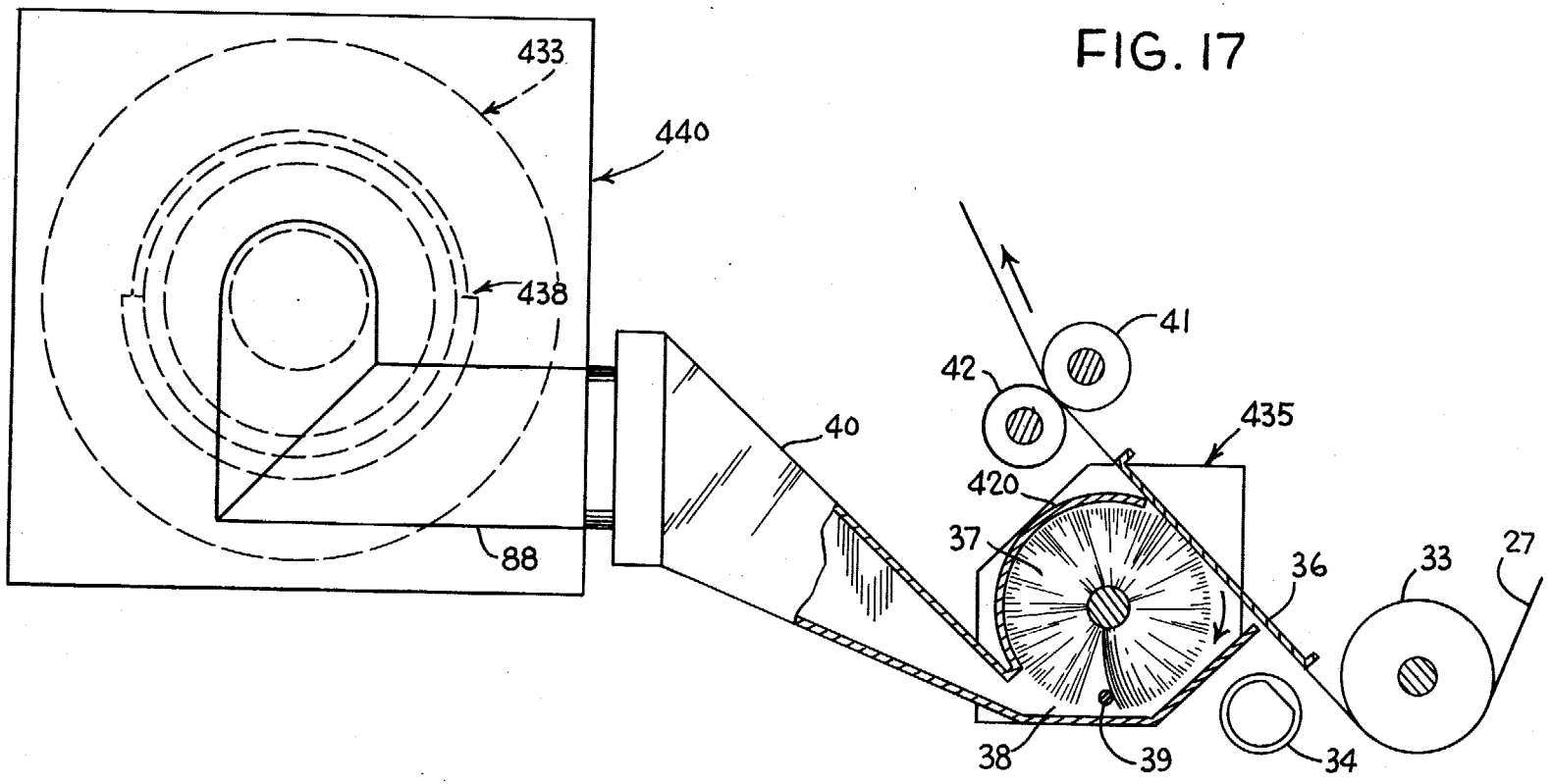
FIG. 17 is a more detailed view of the system for cleaning the photo-receptor sheet of remaining toner particles following the making of a copy.

Although the main elements of the cleaning system are depicted in FIG. 1, the entire system is shown in FIG. 17 so that the various features important to the system will be clearly understood. Although in FIG. 1 brush 37 is shown exposed to view, in actual practice it is desirable to enclose the cleaning system to the maximum extent possible to prevent any toner particles brushed from the photo-receptor sheet from dirtying the base section of the machine. Enclosure 435 in FIG. 17 includes side plates between which sheet 27 moves, ground plate 36 being connected between these plates for supporting the rear surface of the photo-receptor sheet. Enclosure 435, together with ground plate 36, completely encloses brush 37 except for the two slots through which sheet 27 passes.

Brush 37 rotates in the direction shown when clutch CL-3 is energized as described above. The brush bristles, as they move past sheet 27, travel in a direction opposite to that of the sheet for maximum cleaing effect. Although there is a tendency for the particles to adhere to the brush bristles, the particles are flicked free as the bristles are bent by flicking bar 39. The particles which fall off the bristles in region 38 of enclosure 435 are then sucked into duct 40. Circular plate 420, which bears against the tips of the bristles, assists in creating a strong vacuum in region 38 by sealing off the clean side of the brush.

Duct 40 is connected to duct 88 which terminates at the center of bag holder 438 in collector bag assembly 440. The details of this assembly are not shown in the drawings since collector bag assemblies are well known to those skilled in the art. In fact, bag holder 438 is the type into which a Hoover No. C-15631 throw-away bag as shown by the numeral 433 which may be inserted. The far end of assembly 440 when looking in the direction of FIG. 17 may be provided with a removalbe plate so that access may be had to the collector bag. The assembly 440 includes a motor 87 of FIGS. 1 and 3B which creates a vacuum within assembly 440. As in an ordinary vacuum cleaner, air is pulled through ducts 40 and 88 into the collector bag, but because the bag is made of porous paper, the air passes through it and is exhausted from the machine. However, the bag does not permit the toner particles from passing through it and they are collected. Although in ordinary use the collector bag may not be filled until after many years of operation, it is desirable to change the bag whenever the photo-receptor module is replaced; in this way, there is no danger that the collector bag will ever be filled.

It is desirable that all inside surfaces of assembly 440 be coated with sound-deadening material in order to keep the noise level from the vacuum motor-blower to a minimum.

DESCRIPTION OF COPY PAPER SYSTEM — FIGS. 18–21

Figure 20:
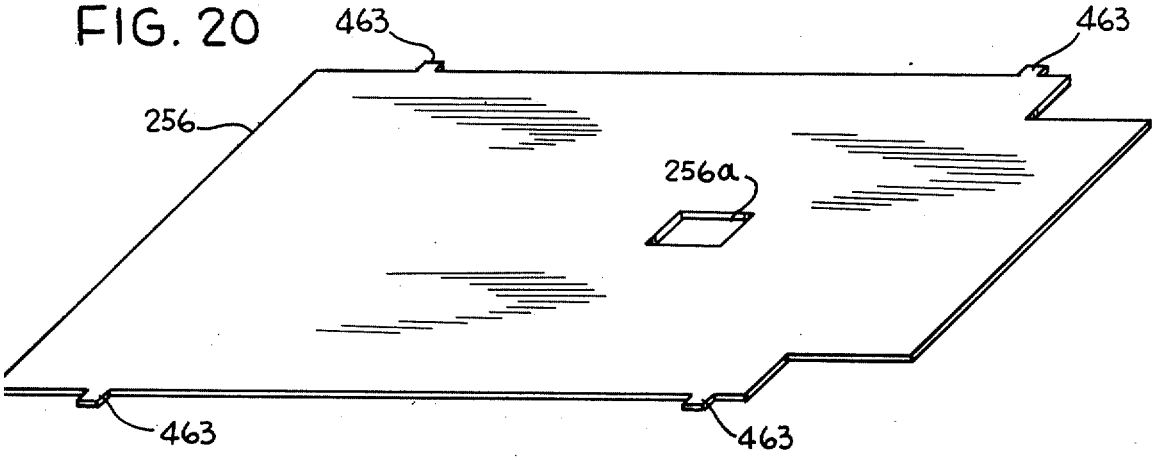
FIG. 20 depicts the shape of plate 56 which is placed in the paper tray.
Figure 18:
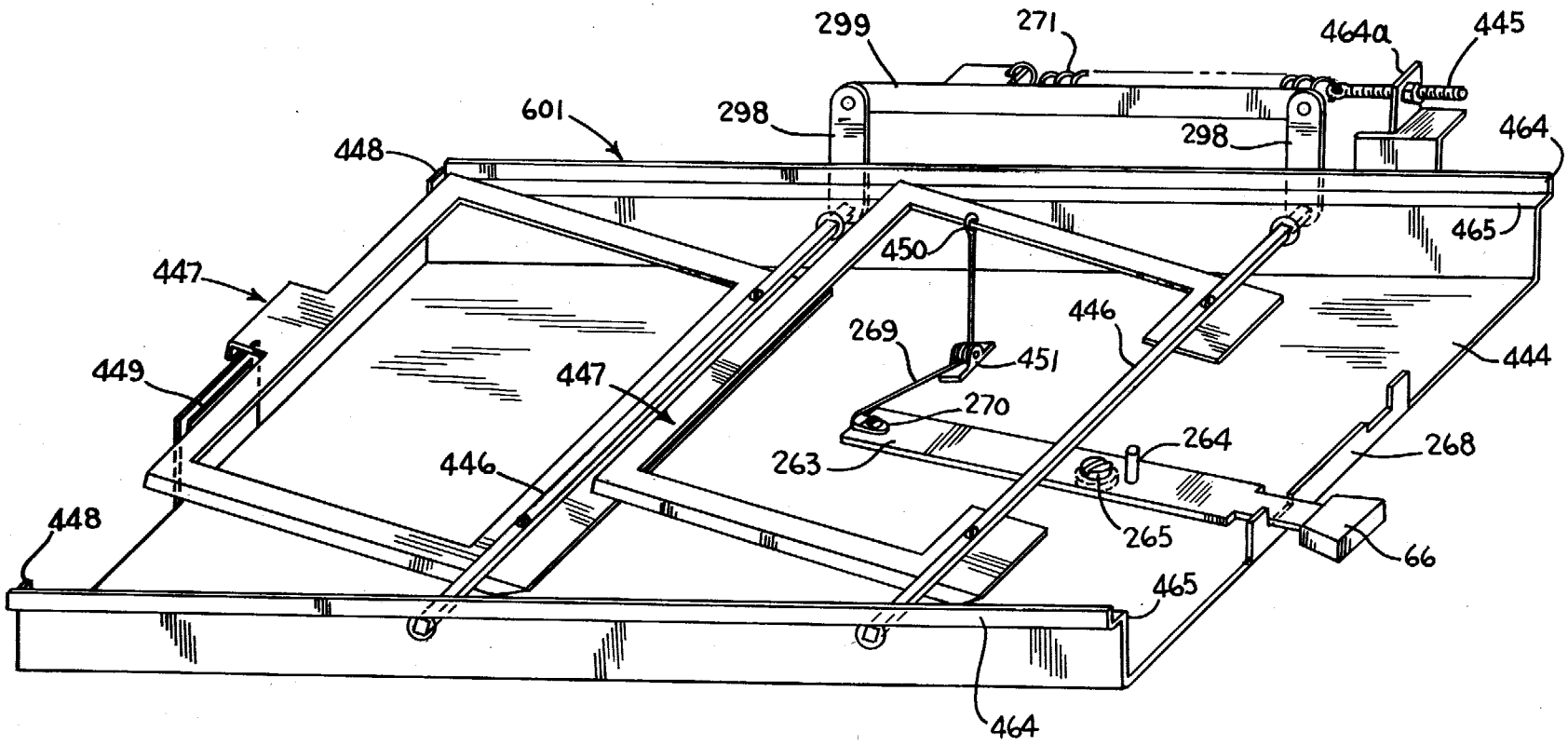
FIG. 18 is a perspective view illustrating the base section of the copy paper system.
Figure 19:
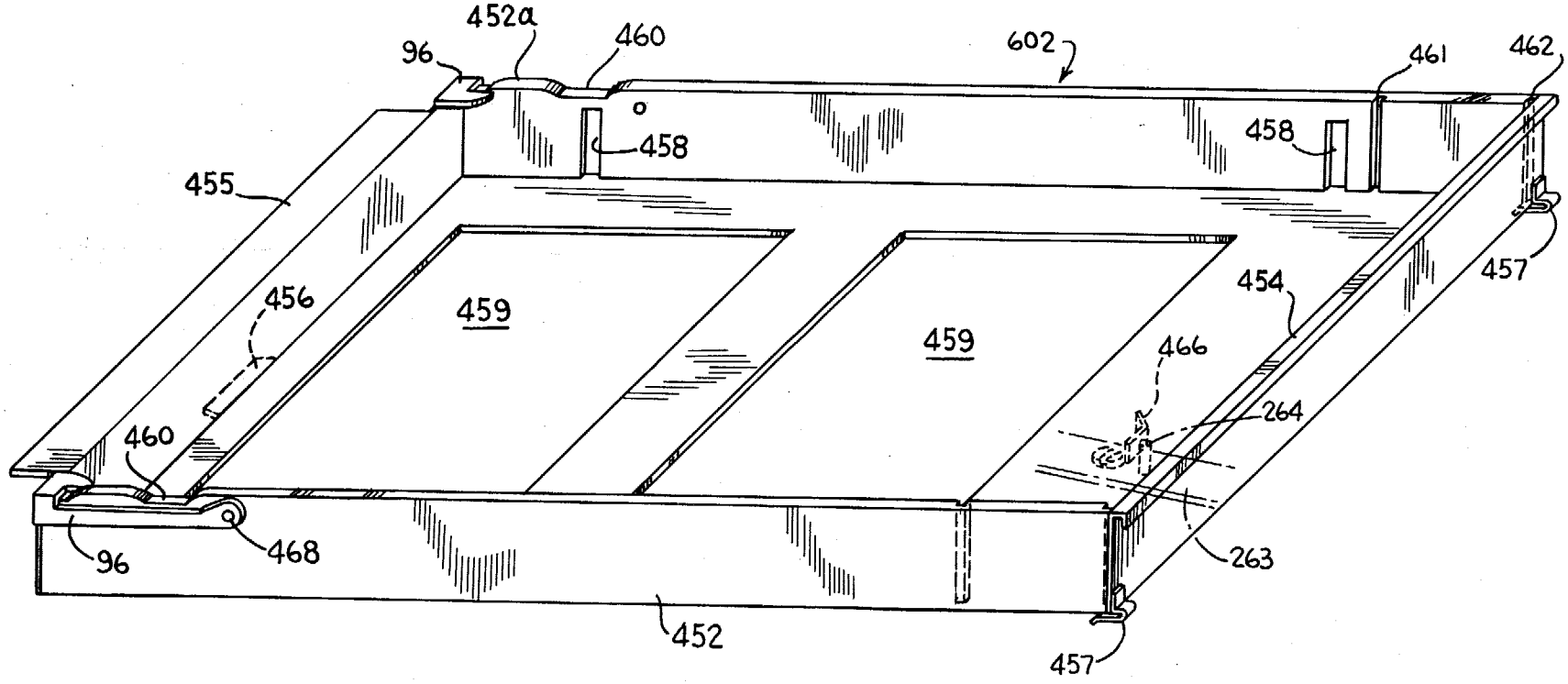
FIG. 19 is a perspective view illustrating the paper tray utilized in the copy paper system.
Figure 21:
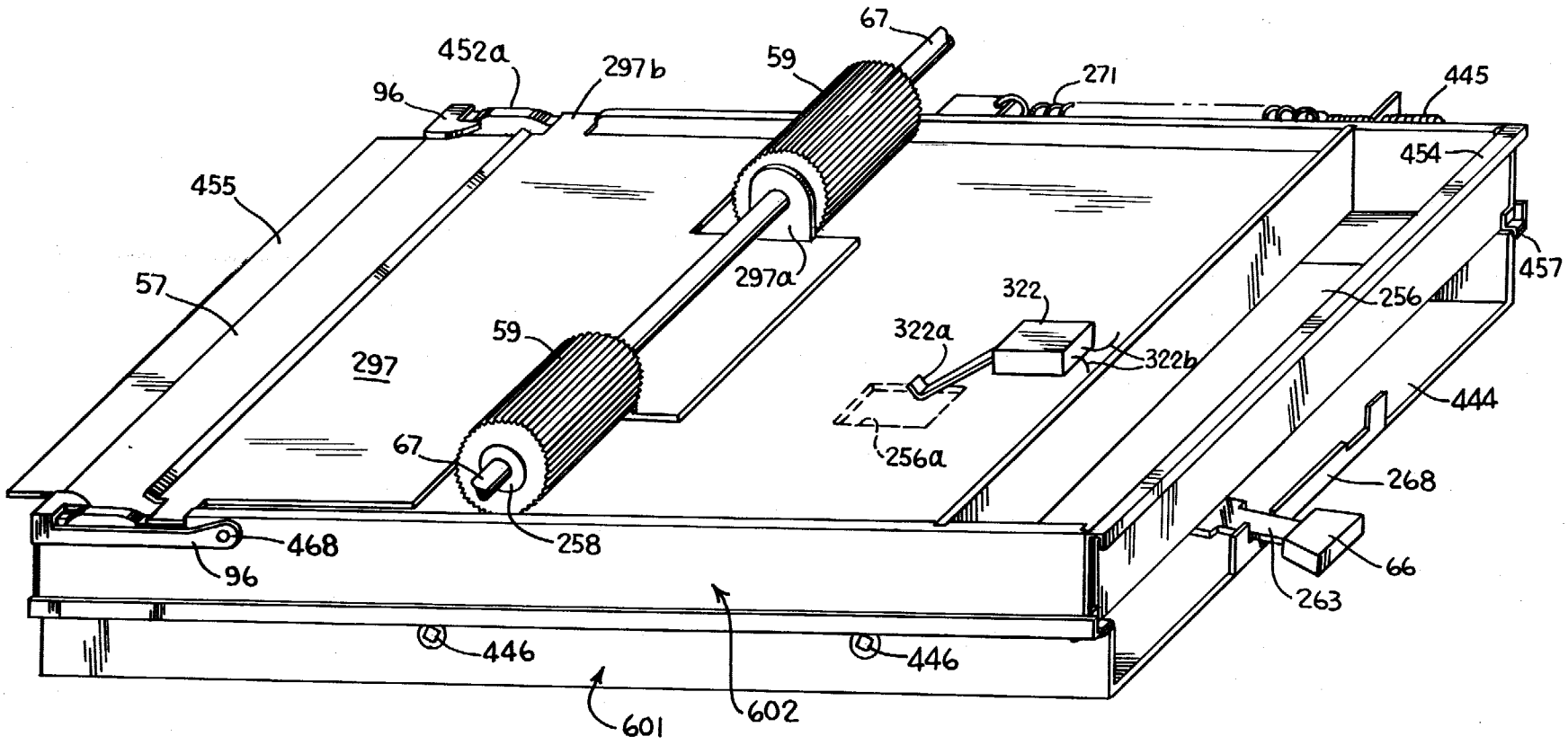
FIG. 21 is a perspective view showing the paper tray secured to the copy paper base section within the machine.

The copy paper system 600 of FIG. 1 includes a base 601 depicted in FIG. 18 which is fixed to the bottom of the base section of the machine, as shown in FIG. 1. The base is completely contained within the base section except for handle 66 which extends out of the machine. A paper tray 602, shown separately in FIG. 19, is supported by the base 601. Depending on the position of handle 66, the paper tray is either secured to the base, or can be removed therefrom for placing a new stack of copy paper in the machine. Plate 56, shown in FIG. 20, is placed in the paper tray, the stack of copy paper actually resting on plate 56. FIG. 21 shows the paper tray in the operative position on the base, and also depicts the manner in which feed rollers 59 bear against the uppermost sheet in the copy paper stack.

The base 601 of FIG. 18 includes a bottom plate 444 with two upstanding side walls. Extending in the horizontal direction from each side wall is a guide surface 465; the paper tray 602 slides along the two guide surfaces as it is moved in and out of the machine. Extending upward from each horizontal guide surface 465 is a vertical guide surface 464 to prevent the paper tray from moving widthwise in the machine. Stops 448 at the forward end of the base 601 limit forward movement of the paper tray. Also at the forward end of the base there is a guide slot 449 into which tang 456 at the bottom of the paper tray of FIG. 19 which fits when the paper tray is in the forward position on the base. Ledge 455 on the paper tray extends forward of the base when the paper tray is inserted in the machine. The rear end of the paper tray is secured to the base by a pair of spring hold-down brackets 457 which engage the rear edges of supporting surfaces 465 of FIG. 21.

Lever 263 is pinned at 265 and can be moved between the "operate" position shown in FIG. 18 in which the paper tray is secured on the base and a "load" position which permits the paper tray withdrawal when handle 66 is moved to the right in FIG. 18. Plate 268 includes two detents into which the rear end of lever 263 can be snapped. The lever at its rear end is biased downwardly by virtue of the fact that pin 265 holds the forward end of the lever flat against the bottom of base 601 with the rear end of the lever thus being bent upward slightly. At the bottom of the paper tray there is a latch bracket 466 as shown in FIG. 19 having one section which is parallel to the rear edge of the tray and another section which is angled slightly. As lever 263 is moved to the "load" position, pin 264 moves past the angled section of bracket 466, thus permitting the paper tray to be withdrawn from the rear of the base 601 by pulling on handle 454. After the paper tray is inserted back in the machine, lever 263 is moved to the "operate" position as shown in phantom in FIG. 19. As the lever is so moved, pin 264 moves past the angled section of bracket 466, and then bears against the flat section. The pin forces bracket 466, and thus the paper tray, to move in the forward direction until the paper tray is pushed all the way in, the pin thereafter preventing withdrawal of the paper tray during machine operation.

The base 601 includes two lifter plates 447, each secured to a bar 446 which is mounted to rotate about its axis. The two bars terminate at one end at respective links 298. The upper ends of the links 298 are interconnected by link 299. Tension spring 271 is connected between link 299 and bracket **464*a*. The spring causes links 298 to rotate in a direction which causes the upper edges of the two lifter plates 447 to move upwardly in the base 601; it is the forward edges of the lifter plates which, as will be described below, force the stack of copy paper upwardly so that the uppermost sheet may be engaged by drive rollers 59. Spring 271 is connected to bracket 464*a* by a conventional tension-adjustment mechanism 445**, the tension being adjusted so that it is large enough to control lifting of even a full stack of copy paper. The spring is designed to provide a more or less constant pressure of the top copy paper sheet against the drive rollers.

When handle 66 is moved to the "load" position, lifter plates 447 rotate downwardly against bottom plate 444 of the base 601 so that the paper tray 602 may be removed from the base without interference from the lifter plates. Cable 269 is secured at one end to the rear lifter plate 447, as shown by the numeral 450. The cable passes under a fixed pulley 451 and terminates at the forward edge of lever 263, as shown by the numeral 270. When the lever is in the "operate" position, the cable 269 is not under tension, and tension spring 271 controls the upward rotation of the lifter plates. But when handle 66 is moved to the "load" position, the forward end of lever 263 moves away from pulley 451, the cable 269 is under tension and the rear lifter plate 447 is pulled downwardly. Due to the linkage arrangement between the two lifter plates, the forward lifter plate is also pulled downwardly at this time. With both lifter plates being positioned adjacent to the bottom of the base 601, the paper tray is free for movement in and out of the machine.

At the bottom of the paper tray as shown in FIG. 19 there are two cut-outs 459. It is through these two cut-outs that the upper edges of lifter plates 447 extend in order to control lifting of the stack of copy paper 57.

The lifter plates do not bear directly against the stack of copy paper. Instead, plate 256 of FIGS. 20 and 21 is placed at the bottom of the paper tray for supporting the stack of copy paper, and the lifter plates push upward on this plate. The two sides of the plate 256 are provided with tangs 463 which move within depressions or grooves 458 provided in the sides 452 of the paper tray, the tangs and depressions thus properly positioning plate 256 within the paper tray but permitting vertical movement. The only contact of the plate 256 with the paper tray is the contact made by the four tangs with the grooves, thus minimizing the friction between the plate and the tray.

The paper tray is designed for use with two basic paper sizes, 8-½ × 11 and 8-½ × 14. When 11 -paper is used, stop plate 453 of FIG. 21 is placed in guide slots 461 of FIG. 19 for bearing against the rear edges of the copy paper. When the large-size copy paper is used, stop plate 453 is placed within guide slots 462.

Conventional paper separator fingers 96 are pivoted at 468 to the sides 452 of the paper tray. As is known in the art, the separator fingers serve to control the feeding of only a single sheet of copy paper from the stack. As the top sheet is moved forward, the separator fingers prevent the forward edge of the sheet from moving past them, momentarily forcing the paper to curl upwardly. When this happens, the side edges of the sheet slide inwardly, and only the top sheet than snaps free and continues to move forward over shelf 455 into the nip of paper feed rollers 60 and 61 of FIG. 1. As described above, feed rollers 59 are turned on shaft 67 for a time interval shorter than the duration of the copy cycle, but sufficient to allow rollers 60 and 61 to take over the function of transporting the copy paper. Clutch CL-1 which controls the turning of shaft 67, disengages before the top copy sheet is moved past feed rollers 59. One-way clutches 258 FIG. 21 are provided for coupling shaft 67 to feed rollers 59. When shaft 67 stops turning as the copy paper sheet continues to be drawn past pressure rollers 59, the pressure rollers simply turn freely on shaft 67 under control of the one-way clutches. The clutches serve to couple shaft 67 to the drive rollers only when the shaft is turned for controlling the transport of the copy paper.

In conventional machines which employ separator fingers 96, the drive rollers comparable to rollers 59 are positioned toward the front edge of the top sheet of copy paper. The curl which forms in the sheet while the leading edge is held by the separator fingers is close to the leading edge, and this in turn results in the top sheet snapping out of the separator fingers. Due to the configuration of the base section of our machine, however, the drive rollers 59 are positioned further back from the leading edge of the copy paper sheet, and the curl which would otherwise form would not be as sharp and would not allow the forward edge of the top sheet of copy paper to snap free of the separator fingers. For this reason, a paper guide 297 is provided as shown in FIG. 21, tangs **297*b* on the sides of the paper guide being held in notches 460 of FIG. 19 on the sides 452 of the paper tray. The rear end of plate 297 is supported by brackets 297*a* which are mounted on shaft 67. Due to the plate, a curl is prevented from developing in the top sheet of copy paper except between the forward edge of the plate and the forward edges of the separator fingers. With the curl thus being contained completely near the forward edge of the top sheet of copy paper, the resulting effect is comparable to that in the prior art and the sheet can snap free of the separator fingers. As in the prior art, when the top sheet of copy paper is curled upwardly at its forward end to a maximum height of about ⅝ths of an inch, the sheet snaps free of the separator fingers and then moves forwardly into the nip of rollers 60 and 61. We have found that for plate 297 to control the proper formation of a curl in the top sheet of copy paper to in turn allow the sheet to snap free, the plate should not bear against the copy paper. Instead, approximately 1/32-inch of space is required between the top of the copy apper stack and the bottom of the plate. This spacing is accomplished by supporting the plate 297 on notches 460 and shaft 67 as described above. The drive rollers 59** limit upward movement of the stack of copy paper at a point at which the uppermost sheet is approximately 1/32 inch below the guide plate.

The front upper edges **452*a* of sides 452 of the paper tray are tapered, both forwardly and rearwardly, as shown in FIGS. 19 and 21. This permits tangs 297*b* to ride over these edges as the paper tray is moved in and out of the machine, plate 297 simply rocking slightly around shaft 67**.

As shown in FIG. 21, switch 322 which is fixed in the base section is disposed such that finger **322*a* is directly above hole 256*a* in plate 256 of FIG. 20. As long as there is copy paper remaining in the tray, the contacts controlled by switch 322 remain open and lamp 184 of FIG. 3D remains off. The contacts are connected to the logic circuit via leads 322*b* in FIG. 21. But when the last sheet of copy paper is used, finger 322*a* drops into hole 256*a*, the switch contacts close, and lamp 184** is illuminated to inform the operator that the copy paper tray must be refilled.

DESCRIPTION OF OPERATION

A three conductor line cord having conductors 235, the "hot" line; 236, the "common"; and 237, the earth ground, connects the copy machine to a suitable source of AC power such as a 120 volt AC wall outlet through a three prong grounded plug. When the main off/on switch 179 is in the "off" position, line current flows through fuser lamp 82 thus sole plate 76 in a "stand-by" semi-heated condition at all times. This feature allows the copy machine to "warm-up" much faster immediately after the main power switch 179 is turned "on". Then, ready lamp 183 "lights up" to indicate that the copy machine is ready to make a copy. As long as the AC power cord is connected to the wall socket, the ready lamp 183 energizes as soon as the main on/off switch 179 is turned on. Otherwise, if the copy machine was not plugged in, a short delay would be incurred to allow fuser sole plate 76 to reach standby ambient temperature controlled by thermal switch TS-1. When the predetermined temperature of fuser sole plate 76 is reached, triac 321, diacs 260 and 261, thermistor 266, potentiometer 259 and capacitor 264 electrically cooperate to keep the temperature of fuser sole plate 76 at a constant level. When TS-1 is closed, power is supplied to switch 242 which is closed only if the photoreceptor sheet 27 has been rewound fewer than 400 times. Switch 242 only opens if the photoreceptor sheet 27 has been rewound 400 times. When switch 242 is closed, power is supplied to relay RY-5, ready lamp 183 main drive motor 100, and filaments of exposure lamps 28 energize to glow continuously to permit rapid turn-on through ballast transformer circuit 221.

When an original document such as a sheet of paper is fed into the copy machine, switch 20 whose sensing finger 19 that is positioned at the nip of original input drive roller 11 and pressure roller 12 closes. This provides power to energize clutch CL-2 of timing circuit TM-5 to control proper initiation of copy paper feed and operate relay RY-2 which initiates the following action. Relays RY-3 and RY-4 are turned on through contacts of relay RY-2 and are latched through their own contacts. The energization of relay RY-3 turns on corona supplies 290 and 291 energizing primary corona 30, negative charged toner transfer corona 34, and positive charged erase corona 35. Relay RY-3 also turns on photoreceptor sheet drive solenoid SOL-3, toner system drive clutch CL-6, cleaning brush drive clutch CL-3, cleaning system vacuum motor 87, and the toner system bias power supply having a transformer 275, diodes 276 and 277, capacitors 278 and 279, and potentiometer 280 which comprise a voltage doubler circuit for deriving a DC potential from the AC source. The energization of relay RY-4 turns on fuser vacuum motor 78 which provides suction for maintaining the copy paper against belts 74 and sole plate 76. Also, when relay RY-4 energizes, normally-closed contacts RY4-1 open and the normally-open contacts RY4-2 close. With the opening of the normally-closed contacts, RY4-1 and the closing of normally-open contacts RY-2, thermistor 266 is no longer connected to the junction of potentiometer 259 and diac 260, but to the junction of potentiometer 258 and diac 261. Adjustment of potentiometer 258 in conjunction with thermistor 266, diac 261, capacitor 263 and triac 321 is such that it allows fuser lamp 82 to increase the heat generated immediately. As proper fusing temperature is reached as determined by the setting of potentiometer 258 feedback information from thermistor 266, the energy input to fuser is reduced so that a constant temperature is maintained. Should thermistor 266 fail so that triac 321 conducts almost continuously thus allowing fuser sole plate 76 to exceed maximum safe temperature level, thermal switch TS-1 will open shutting off the power. Photoreceptor sheet drive solenoid SOL-3 when activated turns on exposure lamp 18 through the solenoid SOL-3 contacts. All other actions are initiated by the closure of switch 20 operating relays RY2, RY3 and RY4. The copying process has now been initiated.

When an original document reaches exposure window 16, radiant energy 17 emitted by exposure lamps 18 reflects back from the document. The reflected energy 22 is directed into lens 46 by mirror 48, then passes through lens 46, and is reflected back through lens 46 by mirror 47 directly behind lens. As the objective lens is 1:1 with the object distance equaling the image distance, the reflected energy 22 is reformed and imaged on moving photoreceptor sheet 27 moves synchronously with the scanning of the original document from supply reel 25 upon closure of switch 20 to stabilizing roller 22, and over pivot roller 29 between coronas 30 where the zinc oxide surface takes on an even electrostatic charge. When the image of the original document in the form of radiant energy 22 strikes the surface of the sensitized photoreceptor sheet 27, a latent image of the original document is formed. The image, which is in the form of electrostatic charges, is formed due to light causing the zinc oxide to become conductive thereby conducting off charge where light strikes and allowing charge to remain where no light strikes surface. Photoreceptor sheet 27 continues moving to the developer area where a magnetic brush 49 saturated with electrostatic toner particles of the opposite polarity to that of the latent image are attracted to the latent image charge on the photoreceptor sheet 27, thus forming a dry toned mirror image of the original document.

The dry toned latent image continues to the transfer area 62, where simultaneously and synchronously, the copy paper 57 arrives due to the closure of timer TM-5 which operates paper feed clutch CL-1. Roller 59 timed by timer TM-5 is on long enough to initially move copy paper 57 from paper tray 452 whereupon it is transported by pressure roller 60 and feed roller 61 to transfer point 62 in synchronization with the toned latent image on photoreceptor sheet 27. Transfer of the dry toned latent image takes place due to transfer corona 34 causing a strong charge of opposite polarity to that of toner particles to be developed on the surface of the copy paper. The toned image thus "transfers" from photoreceptor sheet 27 to the copy paper. After toner transfer, the copy paper continues onto rotating belts 74, through the fuser area where fuser lamp 82 generates the heat required for fusing the toner to the copy paper, and exits the copy machine through fuser pressure roller 84 and drive roller 85.

Photoreceptor sheet 27 continues past transfer area 62. After transfer of the toned latent image, only a small portion of toner dust remains on photoreceptor sheet 27. As any remenant toned image passes erase corona 35, the corona dissipates whatever charge remains on photoreceptor sheet 27 and facilitates subsequent cleaning off of toner particles from the sheet. As photoreceptor sheet 27 continues, cleaning brush 37, rotating in the opposite direction to movement of photoreceptor sheet 27, sweeps off remenant toner allowing vacuum suction in passage 38 to pull the toner particles into duct 40 and vacuum tube and vacuum collector bag 88. Cleaning brush 37 works against photoreceptor sheet 27 backed up by grounded plate 36. As cleaning brush 37 rotates, toner particles tend to cling to the brush bristles. Flicker bar 39 is employed to bend brush bristles so that ends are flicked while in vacuum passage 38, thereby assuring that cleaning brush 37 is free of toner particles before again contacting photoreceptor sheet 27 surface containing remenant toner from latent image.

After leaving the cleaning station, photoreceptor sheet 27 is pulled through drive roller 41 and pressure roller 42 contained in the module 156 to be wound up on takeup reel 26.

If another original document is fed into input drive roller 11 and pressure roller 12 directly after the first original, clutches CL-1 and CL-2 will not release. There must be a delay of approximately 30 milliseconds between the sensing of switch 20 of the trailing edge of one document and the leading edge of another in order for clutch CL-2 to release for successive copies to be made.

When multicopy selector lever 203 on control panel 95 is moved to a position greater than 1 for the number of copies desired, the machine is in a multicopy mode. As soon as a document is fed into original input drive roller 11 and pressure roller 12, switch 20 is closed supplying power to SOL-1 which moves ratchet cam 192 back one position for each copy produced toward the single copy mode position and simultaneously, relay RY-1 energizes. When RY-1 is latched, solenoid SOL-2 is energized through contacts 2 of RY-1 and turnaround guide 186 is flipped down in the position shown in FIG. 1. The document emerges from original drive output roller 13 and pressure roller 14 into nip of pressure roller 14 and pressure roler 187, continues between lower and upper paper guides 188 and 189 into the nip of rollers 12 and 190 causing the document to travel in - loop with its leading edge activating once again switch 20. The original turn-around system is designed to a path length of slightly over 14 inches, the longest original to be copied. Each time switch 20 is triggered, solenoid SOL-1 operates ratchet 192 returning it one position toward the single copy position. At the start of making the last copy, ratchet 192 is returned to the single copy position when the leading edge of the original document is sensed and solenoid SOL-1 operates for the last time. The latching path for relay RY-1 is thus broken and solenoid SOL-2 de-energizes forcing up turnaround guide 186 before the original document reaches rollers 14 and 16 in transport section 201. While the last copy is being made, the machine functions are identical to "single copy mode" functions.

Although the invention has been described with reference to a particular embodiment, it is to be understood that this embodiment is merely illustrative of the application of the principles of the application. Numerous modifications may be made therein and other arrangements may be devised without departing from the spirit and scope of the invention.

We claim:

1. In a copying machine having a base section wherein a photoreceptor web of indefinite length is utilized for the production of copies from an original document, the improvement comprising:

A. a photoreceptor module for insertion into a stationary position in said base section, said module including a supply reel and a take-up reel, each rotatably mounted on said module, said photoreceptor web normally being wound on said supply reel and moved to said take-up reel during successive copying operations of the copying machine, and B. means formed in said base section (i) for removably receiving said module therein through a top portion of said base section whereby said module may be easily removed from said base section and another module substituted therefor, and (ii) for holding said module in a stationary position in said base section.

2. The copying machine of claim 1 wherein said photoconductors module further comprises a continuously operating drive roller for bearing against said photoreceptor web, and said base section further comprises an idler roller normally disengaged from said photoreceptor web, and means for moving said idler roller into engagement with said photoreceptor web and pressing said photoreceptor web against said drive roller whereby said photoreceptor web is moved by the combination of said idler roller engaged against said drive roller.

3. The copying machine of claim 1 further comprising means for controlling actuation of said photoreceptor web in said photoreceptor module as said photoreceptor web moves between said reels and past means sequentially arranged in said base section for charging, exposing, and developing of said photoreceptor web, image transfer to copy paper, and cleaning of said photoreceptor web.

4. The copying machine of claim 3 wherein said controlling means moves said photoreceptor web in a first direction from said supply reel to said take-up reel during each copy cycle and in a direction opposite to said first direction for rewinding said photoreceptor sheet onto said supply reel.

5. The copying machine of claim 4 wherein incremental sections of said photoreceptor web are moved in said first direction during successive copy cycles and substantially all of said photoreceptor web is moved continuously in said opposite direction when said photoreceptor web is rewound on said supply reel.

6. The copying machine of claim 5 wherein said photoreceptor web is moved at a faster speed in said opposite direction than in said first direction.

7. The copying machine of claim 4 further comprising means for counting the number of times said photoreceptor web is rewound.

8. The copying machine of claim 1 wherein said supply and take-up reels are located in parallel relationship in said module, and said photoreceptor web is moved in a path which is substantially downward on a side of said supply reel furthest away from said take-up reel, underneath said supply reel, and upward toward said take-up reel.

9. The copying machine of claim 8 wherein said upward path is between said supply and take-up reels.

10. The copying machine of claim 8 wherein charging, exposing and developing means are arranged along the downward part of said path, image transferring to copy paper means is arranged along that part of said path which is underneath said supply reel, and cleaning means is arranged along the upward part of said path.

11. The copying machine of claim 10 wherein said path along which said photoreceptor web is moved is at an average angle to a line between axes of said reels which equals or is greater than 45 degrees, said average angle being taken as the smaller of the two angles which the corresponding path segment makes with said line.

12. The copying machine of claim 10 wherein the length of said path along which said photoreceptor web moves is at least three times greater than the minimum length of a tangential line between the circumferences of said photoreceptor web wound on said reels.

13. The copying machine of claim 10 wherein said path of said photoreceptor web changes by more than 110 degrees as said photoreceptor web moves between said reels.

14. The copying machine of claim 10 wherein said photoreceptor module includes means for guiding edges of said photoreceptor web over at least 70% of said path between said supply and take-up reels to prevent skewing of said photoreceptor web during movement thereof.

15. The copying machine of claim 4 further comprising means for sensing when substantially all of said photoreceptor web is wound on said take-up reel, and means responsive to said sensing means for automatically initiating the rewinding of said photoreceptor web onto said supply reel.

16. The copying machine of claim 15 further comprising means for delaying the rewinding of said photoreceptor web until after a copy cycle in progress is completed when said sensing means operates during such copy cycle.

17. The copying machine of claim 4 further comprising first means for controlling sequential scanning of an original document several times in succession when it is desired to make multiple copies thereof, second means for sensing when a predetermined length of said photoreceptor web which is less than substantially all of said photoconductor web is wound on said take-up reel, and means responsive to the operation of both said first and second sensing means for initiating the rewinding of said photoreceptor web prior to the making of any subsequent copies.

18. The copying machine of claim 4 further comprising a main on/off switch, first means for enabling copies to be made only when said switch is in the on position, second means for sensing when a predetermined length of said photoreceptor web which is less than substantially all of said photoreceptor web is wound on said take-up reel, and means responsive to the operation of said second means and to said main switch being placed in the off position for automatically initiating the rewinding of said photoreceptor web on said supply reel.

19. The copying machine claim 7 wherein said developing means comprises means for placing said photoreceptor web in an electric field, and means responsive to a count in said counting means for varying the magnitude of said electric field such that the quality of copies made on the machine remains substantially invariant even as said photoreceptor web is repeatedly charged and exposed and its photoreceptive characteristics change.

20. The copying machine of claim 1 wherein said base section further comprises means for controlling mechanical movements in said base section, means for logically controlling electrophotocopy sequences during a copy cycle; and said module means further comprises means for controlling mechanical movements in said module which are engageable with said base section mechanical control means for driving said module mechanical controlling means when said module is inserted into said base section, and means for sensing how much photoconductor web is available for making copies connected with said base section logic means when said module is inserted in said base section to enable said logic means to control operations of said module.

21. The copying machine of claim 4 further comprising a main power on-off switch, means for enabling copies to be made only when said main power switch is in the on position, and means for initiating the rewinding of said photoreceptor web when the remaining length of said photoreceptor web which can be moved in said first direction is less than a predetermined length.

22. The copying machine of claim 1 further comprising a fuser, means for feeding a copy sheet into said fuser, means for sensing a predetermined time period of not less than thirty milliseconds between a trailing edge of one original document and the leading edge of another original document, and means for preventing the feeding of another copy sheet until said predetermined time period elapses in order to prevent a paper jam in said fuser.

23. The copying machine of claim 1 further comprising toner supply means, means for applying toner which is furnished from said toner supply means, means securing said toner applying means and said toner supply means in a unitary assembly which is mounted for slidable withdrawal from or insertion into said base section.

24. The copying machine of claim 1 wherein said base section further comprises a copy paper supply means including a support section extending upward from said base section and being biased in the upward direction, a tray for containing a stack of copy paper sheets therein mounted on top of said support section for slidable disengagement therefrom and withdrawal from said base section, means in said tray including holes at the bottom thereof for lifting said stack of copy paper, means for transporting the uppermost sheet in said stack, and a handle for operating said copy paper supply means, said handle having a first position for locking said tray on top of said support section and allowing said lifting means to extend upward into said tray to lift said stack of copy paper into engagement with said transporting means and a second position for unlocking said tray and pulling down said lifting means below said tray so that said stack of copy paper is disengaged from said transporting means to permit the withdrawal of said tray from said base section.

25. The copying machine of claim 7 further comprising means responsive to said counting means for determining when the number of times said photoreceptor web is moved in said second direction exceeds a predetermined number and for indicating that said photoreceptor web should be replaced.

26. The copying machine of claim 7 further comprising means responsive to said counting means for preventing any copy cycles from taking place when a count in said counting means reaches a predetermined value.

27. The copying machine of claim 3 wherein said toning transfer means slides in and out through a side portion of said base section.

28. The copying machine of claim 3 wherein said cleaning means comprises a brush and flicker bar cooperating together for removing any toner particles which may remain on said photoreceptor sheet after it moves past said transferring means in said first direction during a copy cycle.

29. The copying machine of claim 28 wherein said cleaning means further comprises a means in said base section for vacuuming off any toner particles which are brushed off said photoreceptor sheet by said brush means.

30. The copying machine of claim 3 wherein copy paper supply means are insertable and removable through an end of said base section.

31. The copying machine of claim 3 wherein a fuser means is insertable and removable through an end of said base section.

* * * * *

UNITED STATES PATENT AND TRADEMARK OFFICE

CERTIFICATE OF CORRECTION

PATENT NO. : 4,084,901

DATED : April 18, 1978

INVENTOR(S) : Torulf F. Aasen, Jules Nisenson, Charles E. Pegg

It is certified that error appears in the above-identified patent and that said Letters Patent are hereby corrected as shown below:

Column 7, line 22, change "is" to -- in --

Column 8, line 22, change "whould" to -- would --

Column 10, line 8, after "FIG. 1" insert -- is --

Column 10, line 56, change "fixid" to -- fixed --

Column 16, line 12, change "operates" to -- operate --

Column 17, line 26, change "conduction" to -- conductor --

Column 27, line 20, change "deliverately" to -- deliberately --

Column 27, line 21, change "copyiny" to -- copying --

Column 31, line 57, change "1/16" to -- 1/16" --

Column 32, line 37, change ".02" to -- .02" --

Column 33, line 23, change "3/8" to -- 3/8" --

Column 34, line 30, change "1/16" to -- 1/16" --

Column 34, line 65, change "cleaing" to -- cleaning --

Column 35, line 12, delete "which" after "433"

Column 35, line 14, change "removalbe" to -- removable --

Column 35, line 62, delete "which" after "19"

UNITED STATES PATENT AND TRADEMARK OFFICE

CERTIFICATE OF CORRECTION

PATENT NO. : 4,084,901

DATED : April 18, 1978

INVENTOR(S) : Torulf F. Aasen, Jules Nisenson, Charles E. Pegg

It is certified that error appears in the above-identified patent and that said Letters Patent are hereby corrected as shown below:

Column 37, line 15, change "8 1/2 X 11" to -- 8 1/2" X 11" -- and change "8 1/2 X 14" to -- 8 1/2" X 14" -- and change "11" to -- 11" --

Column 37, line 28, change "than" to -- then --

Column 38, line 11, change "apper" to -- paper --

Column 38, line 44, after "82" insert -- ; -- and after "76" insert -- is --

Column 38, line 65, after "ready lamp 183" insert a comma

Column 39, line 55, after "sheet 27" insert -- which --

Column 41, line 2, the second occurrence of "roller" is misspelled (roler)

Signed and Sealed this

*Thirty-first* Day of *August 1982*

[SEAL]

*Attest:*

GERALD J. MOSSINGHOFF

*Attesting Officer*

*Commissioner of Patents and Trademarks*